US008425078B2

(12) United States Patent
Matthews et al.

(10) Patent No.: US 8,425,078 B2
(45) Date of Patent: Apr. 23, 2013

(54) LIGHTING DEVICE WITH MULTI-POSITION JOYSTICK

(75) Inventors: John W. Matthews, Newport Beach, CA (US); Ammar Burayez, Silverado, CA (US); Luis M. Sanchez, Long Beach, CA (US); William A. Hunt, Foothill Ranch, CA (US); Michael D. Picciotta, Yorba Linda, CA (US); Andrew Castañeda, Anaheim, CA (US)

(73) Assignee: SureFire, LLC, Fountain Valley, CA (US)

( * ) Notice: Subject to any disclaimer, the term of this patent is extended or adjusted under 35 U.S.C. 154(b) by 413 days.

(21) Appl. No.: 12/887,257

(22) Filed: Sep. 21, 2010

(65) Prior Publication Data

US 2012/0068624 A1 Mar. 22, 2012

(51) Int. Cl.
*F21L 4/04* (2006.01)

(52) U.S. Cl.
USPC ..... 362/206; 362/205; 362/394

(58) Field of Classification Search ..... 362/110, 362/113, 119, 183, 197, 200–208, 249.01, 362/249.02, 249.05, 271, 274, 275, 276, 362/295, 394
See application file for complete search history.

(56) References Cited

U.S. PATENT DOCUMENTS

| | | | |
|---|---|---|---|
| 1,214,583 | A | 2/1917 | Persons |
| 4,388,673 | A | 6/1983 | Maglica |
| 4,499,525 | A | 2/1985 | Mallory |
| 4,527,223 | A | 7/1985 | Maglica |
| 4,581,686 | A | 4/1986 | Nelson |
| 4,677,533 | A | 6/1987 | McDermott et al. |
| 4,760,504 | A | 7/1988 | Schaller et al. |
| 4,782,432 | A | 11/1988 | Coffman |
| 4,876,416 | A | 10/1989 | Frantz et al. |
| 4,947,291 | A | 8/1990 | McDermott |
| 5,161,879 | A | 11/1992 | McDermott |
| 5,418,433 | A | 5/1995 | Nilssen |
| 5,498,934 | A | 3/1996 | Nilssen |
| 5,629,105 | A | 5/1997 | Matthews |
| 5,642,932 | A | 7/1997 | Matthews |
| 5,685,637 | A | 11/1997 | Chapman et al. |
| 5,722,755 | A | 3/1998 | Slape |

(Continued)

FOREIGN PATENT DOCUMENTS

GB 2344230 5/2000

OTHER PUBLICATIONS

U.S. Appl. No. 12/887,271, filed Sep. 21, 2010, inventors: Matthews et al., pp. 1-52.
U.S. Appl. No. 12/887,271, Matthews et al.

*Primary Examiner* — Hargobind S Sawhney
(74) *Attorney, Agent, or Firm* — Haynes and Boone, LLP

(57) ABSTRACT

Various lighting devices and related methods are provided. In one example, a portable lighting device includes a light source, lighting control circuitry, a body, and a tailcap assembly attached to an end of the body. The tailcap assembly includes a multi-position joystick adapted to pivot relative to the body in response to lateral pressure and move vertically relative to the body in response to vertical pressure. The tailcap assembly also includes switches adapted to provide signals to the lighting control circuitry in response to pivot movement and vertical movement of the joystick. The lighting control circuitry is adapted to operate the light source in response to the signals.

25 Claims, 18 Drawing Sheets

U.S. PATENT DOCUMENTS 5,790,013 A 8/1998 Hauck
5,821,697 A 10/1998 Weber
6,019,482 A 2/2000 Everett
6,024,471 A 2/2000 McDermott
6,046,572 A 4/2000 Matthews et al.
6,079,847 A 6/2000 Nelson
6,095,661 A 8/2000 Lebens et al.
6,183,105 B1 2/2001 Parker
6,222,138 B1 4/2001 Matthews et al.
6,249,089 B1 6/2001 Bruwer
6,296,367 B1 10/2001 Parsons et al.
6,305,818 B1 10/2001 Lebens et al.
6,307,328 B1 10/2001 Ko et al.
6,386,730 B1 5/2002 Matthews
6,402,339 B1 6/2002 Mukogawa et al.
6,616,296 B1 9/2003 Roux et al.
6,793,366 B2 9/2004 Chun
6,841,941 B2 1/2005 Kim et al.
7,090,374 B2 * 8/2006 Arthur ..... 362/205
7,116,061 B2 10/2006 Kim et al.
7,186,002 B2 3/2007 Matthews et al.
7,220,016 B2 5/2007 Matthews et al.
7,281,815 B1 10/2007 Gustafson et al.
7,293,893 B2 11/2007 Kim
RE40,125 E 3/2008 Matthews et al.
7,344,270 B2 3/2008 Kim
7,527,388 B2 5/2009 Kim
7,534,975 B1 5/2009 Sharrah et al.
7,540,625 B2 6/2009 Matthews et al.
7,566,149 B2 7/2009 Koch et al.
7,722,209 B2 * 5/2010 Matthews et al. ..... 362/205
2003/0106782 A1 6/2003 Galli
2004/0008510 A1 1/2004 Mah
2004/0190286 A1 9/2004 Chapman
2005/0077837 A1 * 4/2005 Kim et al. ..... 315/200 A
2005/0122712 A1 6/2005 Kim
2005/0237737 A1 10/2005 Kim
2006/0164828 A1 7/2006 Kim
2007/0195522 A1 8/2007 Matthews et al.
2007/0247839 A1 10/2007 Matthews et al.
2008/0272714 A1 11/2008 Noble et al.
2010/0090613 A1 4/2010 Spartano
2010/0219775 A1 9/2010 Maglica et al.
2010/0277295 A1 11/2010 Matthews et al.

* cited by examiner

LIGHTING DEVICE WITH MULTI-POSITION JOYSTICK

BACKGROUND

1. Technical Field

This disclosure generally relates to lighting devices and more particularly to the switching of lighting devices to operate in various modes.

2. Related Art

Conventional lighting devices (e.g., flashlights, headlamps, or others) are often implemented with relatively simple two-wire circuits in which a lighting element is connected to a switch and a battery through a resistor. Such a configuration typically allows for only simple on/off switching of the lighting device and does not permit more sophisticated lighting operations to be performed.

More advanced configurations may be implemented with multiple user-selectable controls. Unfortunately, such controls are often poorly implemented in ways that make them cumbersome to use and may require two hands to operate. Also, such controls may be confusing to users. As a result, such controls are often inconvenient and may be particularly troublesome to use in crisis situations where illumination is immediately required.

SUMMARY

Various lighting devices and related methods are provided. In one embodiment, a portable lighting device includes a light source; lighting control circuitry; first and second power terminals adapted to receive a battery power source; first and second electrical connections between the lighting control circuitry and the first and second power terminals; a third electrical connection between the second power terminal and the lighting control circuitry; and a switch adapted to selectively connect and disconnect the third electrical connection, wherein the lighting control circuitry is adapted to operate the light source in response to a signal received over the third electrical connection in response to the switch, wherein the first and second electrical connections are adapted to provide constant power to the lighting control circuitry while the battery power source is connected to the first and second power terminals regardless of operation of the switch.

In another embodiment, a method of operating a portable lighting device includes providing constant power to lighting control circuitry from a battery power source through first and second electrical connections between the lighting control circuitry and first and second power terminals of the battery power source regardless of operation of a switch; receiving a manipulation of the switch to connect or disconnect a third electrical connection between the second power terminal and the lighting control circuitry; receiving a signal over the third electrical connection in response to the switch; and operating a light source by the lighting control circuitry in response to the signal.

In another embodiment, a portable lighting device includes a light source; lighting control circuitry; a body; and a tailcap assembly attached to an end of the body, the tailcap assembly comprising: a multi-position joystick adapted to pivot relative to the body in response to lateral pressure and move vertically relative to the body in response to vertical pressure, and switches adapted to provide signals to the lighting control circuitry in response to pivot movement and vertical movement of the joystick, wherein the lighting control circuitry is adapted to operate the light source in response to the signals.

In another embodiment, a method of operating a portable lighting device comprising a light source, lighting control circuitry, a body, and a tailcap assembly comprising a multi-position joystick and a plurality of switches is provided. The method includes receiving lateral pressure at the joystick; permitting the joystick to pivot relative to the body in response to the lateral pressure; receiving vertical pressure at the joystick; permitting vertical movement of the joystick relative to the body in response to the vertical pressure; operating switches in response to pivot movement or vertical movement of the joystick; receiving signals at the lighting control circuitry in response to the switches; and operating the light source by the lighting control circuitry in response to the signals.

The scope of the disclosure is defined by the claims, which are incorporated into this section by reference. A more complete understanding of embodiments will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE FIGURES

Embodiments of the disclosure and their advantages are best understood by referring to the detailed description that follows. It should be appreciated that like reference numerals are used to identify like elements illustrated in one or more of the figures.

DETAILED DESCRIPTION

Figure 1:
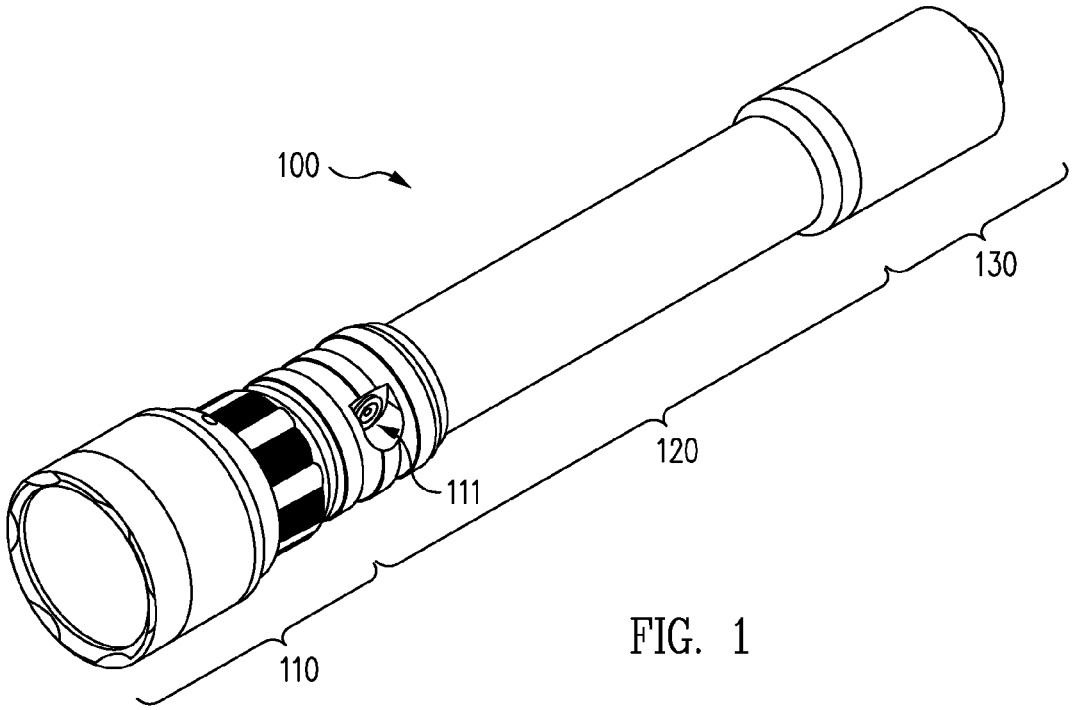
FIG. 1 is a perspective view of a flashlight in accordance with an embodiment.

In accordance with various embodiments described herein, multiple user controls may be implemented in a lighting device (e.g., a portable lighting device), such as a tailcap of a rechargeable or non-rechargeable flashlight. In one embodiment, a multi-stage switching arrangement may be provided in a tailcap assembly that permits users to switch between a constant on/off mode to a momentary on/off mode with just one hand. Such an embodiment may be advantageous during crisis situations, such as during combat, and does not require the user to use a second hand to twist or otherwise manipulate the tailcap.

In one embodiment, such an arrangement may be implemented using a joystick which may be moved to various positions (e.g., stages) which move one or more washers and/or springs to effectively open and/or close various circuits to effectuate switching For example, various switches may be selectively operated by pressing down on a joystick (e.g., applying downward pressure or force) to transition between various positions and/or by pushing the joystick to the side (e.g., applying lateral pressure or force) through one or more positions. When moved to the different positions (e.g., press down, press down further, push to the side, and push further to the side in one embodiment), resistors of different resistance values may be introduced into a circuit. The different resistance values may be detected by lighting control circuitry of the lighting device as signals to operate in various modes. Such modes may include, for example: momentary on/off modes to turn on a light source when the joystick is moved to a given position and turn off the light source after the joystick is released from the position; constant on/off modes to turn on a light source when the joystick is moved to a given position, keep the light source turned on after the joystick is released from the position, and turn off the light source after the joystick is moved to the same and/or a different position; light intensity adjustment modes in which the brightness of a light source changes in response to different joystick positions; pattern modes in which a light source flashes in accordance with a pattern; light source selection modes in which different light sources are selected for use; and any other modes as may be desired in particular implementations.

In one embodiment, different positions may be used simultaneously. For example, the joystick may be pushed down to one or more positions and moved to the side to one or more positions simultaneously if desired.

In one embodiment, a washer with multiple arms may be used to capture movement of a joystick, such as 360 degree movement. Such an embodiment may also include an additional washer with multiple arms to capture the pushing-in movement of the joystick. In one embodiment, the joystick may be installed on a spring providing on-axis centering.

In another embodiment, a lighting device, such as a flashlight, may be implemented to provide a complete circuit from a power source (e.g., one or more batteries and/or another power source) to lighting control circuitry (e.g., a microcontroller, microprocessor, and/or other circuitry) of the device such that the lighting control circuitry is constantly powered on (e.g., in a stand by or idle state) and ready to receive switched input signals from user-operable controls (e.g., switches) of the lighting device to control the operation of a light source. In this regard, electrical connections (e.g., also referred to as conductive paths, wires, and electrical traces) may be provided from a power source to lighting control circuitry to maintain the lighting control circuitry in a powered state. Maintaining the lighting control circuitry in a powered state may reduce the likelihood of sparks being created when the light source is switched on. Such an implementation may be particularly advantageous in certain environments and activities, such as mining and explosive areas.

An additional electrical connection may be provided between the power source and the lighting control circuitry. One or more switches (e.g., user-operable switches) may be used to selectively open or close the additional electrical connection and/or introduce one or more resistors between the power source and the lighting control circuitry.

In one embodiment, this additional electrical connection may be provided by a conductive housing of a body of the lighting device. For example, the housing may be used as a conduit for providing switching signals from switches in a tailcap assembly of a flashlight to lighting control circuitry in a head of the flashlight.

In one embodiment, the additional electrical connection may be used in an implementation of the lighting device that also uses a multi-stage switching arrangement as described herein. Moreover, any desired combinations of the various embodiments described herein may be used as desired in particular implementations.

FIG. 1 is a perspective view of a flashlight 100 in accordance with various embodiments. As shown, flashlight 100 includes a head 110, a body 120, and a tailcap assembly 130. In various embodiments, flashlight 100 may be implemented as a rechargeable or non-rechargeable flashlight. In this regard, a recharging port 111 may be provided in rechargeable embodiments.

Figure 2:
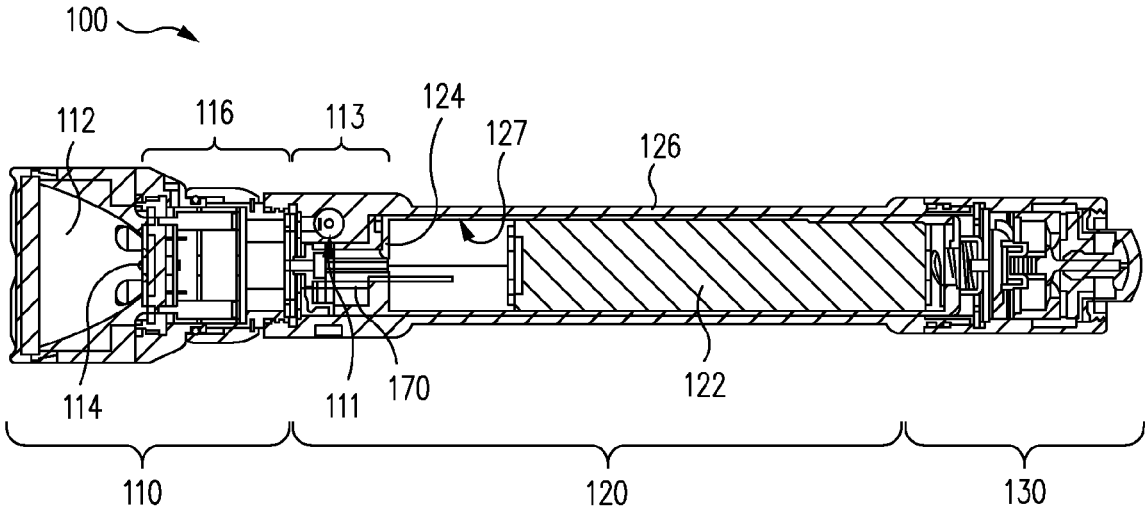
FIG. 2 is a sectional view of the flashlight of FIG. 1 in accordance with an embodiment.

FIG. 2 is a sectional view of flashlight 100 in accordance with an embodiment. As shown, head 110 includes optics/reflector 112 (e.g., which may include a total internal reflection (TIR) lens or any other lens, and/or other optical components as desired), one or more light sources 114 (e.g., one or more light emitting diodes (LEDs), filament lamps, arc lamps, and/or any other light sources), and lighting control circuitry 116 (e.g., active or passive circuitry, a microprocessor, a microcontroller, and/or other circuitry which may operate light source 114 in response to signals received in response to user-operable switches).

Body 120 includes recharging port 111, a housing 126, and a power source 122 (e.g., one or more batteries such as lithium ion batteries, other types of batteries, and/or other power sources). In rechargeable embodiments, power source 122 may be connected to recharging port 111 through recharging circuitry 113 (e.g., used to recharge power source 122). A power terminal 173 (see FIG. 3) is adapted to receive power source 122 (e.g., a positive battery terminal in one embodiment) and is connected to lighting control circuitry 116 through an electrical connection 170 (e.g., a wire or other type of electrical connection). Another power terminal 172 (see FIG. 3) is adapted to receive power source 122 (e.g., a negative battery terminal in one embodiment) and is connected to lighting control circuitry 116 through an electrical connection 124 (e.g., a wire or other type of electrical connection). In this regard, electrical connections 124/170 may remain connected between terminals 172/173 and lighting control circuitry 116 to provide a constant electrical connection and constant power between power source 122 and lighting control circuitry 116. As such, lighting control circuitry 116 may remain constantly powered and ready for use in such an embodiment.

In one embodiment, housing 126 may be conductive so as to provide an additional electrical connection that may be selectively connected and disconnected between power terminal 172 and lighting control circuitry 116 in response to a switch. In one embodiment, such a switch may be provided by rotation of tailcap assembly 130 relative to housing 126. Body 120 may also include a sleeve 127 which may be used to insulate power source 122 and electrical connection 124 from housing 126.

In one embodiment, housing 126 may be made from a conductive material (e.g., aluminum, another metal, or another conductive material) and sleeve 127 may be made from a non-conductive material (e.g., polymer, plastic, or another non-conductive material) to insulate electrical connections 124 and/or 170 from housing 126. As a result, separate electrical connections may be provided from power terminal 172 to head 110 (e.g., one connection may be provided by electrical connection 124 and another connection may be provided by housing 126).

Other configurations are also contemplated. For example, in another embodiment, housing 126 may be made from a non-conductive material, and sleeve 127 may be made from a conductive material. In this regard, one or more additional conductive and/or non-conductive components (e.g., additional electrical connections, conductive and/or non-conductive sleeves, or other components) may be provided (e.g., in nested configurations and/or otherwise) to provide two or more separate electrical connections from tailcap assembly 130 to head 110 as may be desired in particular implementations.

Tailcap assembly 130 may provide various user-operable switches as described herein. Although user-operable switches are described herein with regard to tailcap assembly 130, it is contemplated that one or more user-operable switches may be provided on head 110 and/or body 120 in various embodiments.

Figure 3:
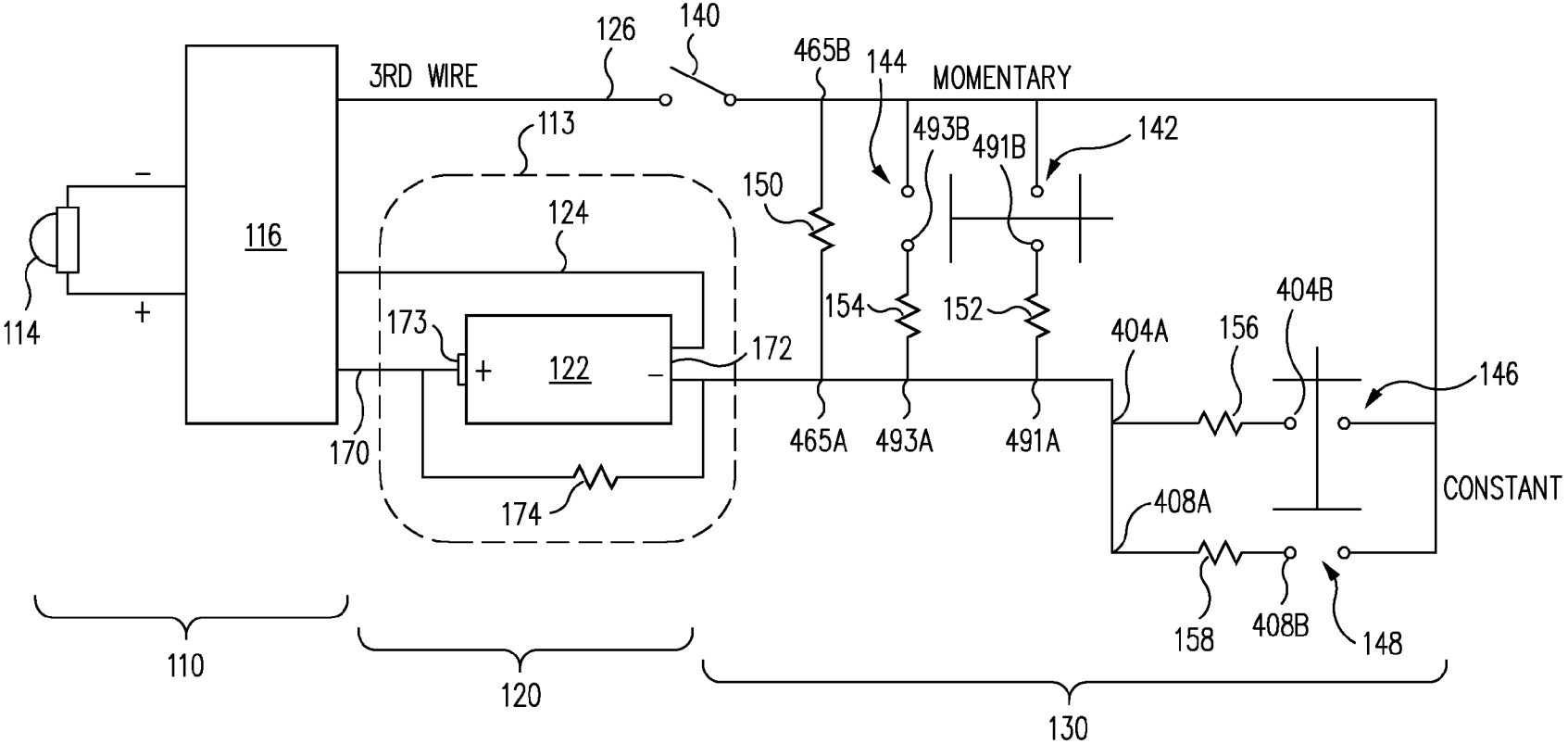
FIG. 3 is a circuit diagram which may be used to implement the flashlight of FIG. 1 in accordance with an embodiment.

FIG. 3 is a circuit diagram which may be used to implement flashlight 100 using tailcap assembly 130 in accordance with an embodiment. As shown, tailcap assembly 130 includes various user-operable switches 140, 142, 144, 146, and 148 which may be used to selectively connect one or more resistors 150, 152, 154, 156, and 158 to lighting control circuitry 116 through electrical connection 126. As shown, various connections between lighting control circuitry 116, power source 122, and other components may pass through recharging circuitry 113 which is conceptually represented in FIG. 3 by a broken line.

Lighting control circuitry 116 may detect signals such as changes in voltage, current, and/or resistance as switches 140, 142, 144, 146, and 148 cause various resistors 150, 152, 154, 156, and 158 to be connected between a terminal of power source 122 and housing 126. In response to such signals, lighting control circuitry 116 may operate light source 114 in any desired fashion. For example, lighting control circuitry 116 may turn light source 114 on or off, adjust the brightness (e.g., intensity) of light source 114, flash light source 114 in any desired pattern, select one or more different light sources 114 (e.g., in embodiments where multiple light sources 114 are provided), and/or perform any other operation as desired.

In some embodiments, each of resistors 150, 152, 154, 156, and 158 may have a different resistance value such that lighting control circuitry 116 may detect the switching of any combination of switches 140, 142, 144, 146, and 148. For example, in some embodiments, resistors 150, 152, 154, 156, and 158 may be implemented with resistances that differ from each other (e.g., by a factor of two or any other desired factor). In one embodiment, the following resistance values may be used: resistor 150 (100 kohm), resistor 152 (4 kohm), resistor 154 (2 kohm), resistor 156 (25 kohm), and resistor 158 (12.5 kohm). Resistors 150, 152, 154, 156, and 158 may be implemented with any desired resistance values in other embodiments.

In one embodiment, resistors 150, 152, 154, 156, and 158 may be surface mounted resistors connected to various nodes. In this regard, nodes are identified in FIG. 3 corresponding to pads (e.g., conductive surfaces or other types of electrical connections) 404A-B, 408A-B, 465A-B, 491A-B, and 493A-B that are identified in other figures discussed herein. In order to more clearly show the structure of the pads, they are illustrated without the resistors in other figures discussed herein. In other embodiments, other types of resistors may be used (e.g., embedded in PCBs or otherwise).

In one embodiment where power source 122 is a rechargeable battery pack, a resistor 174 (e.g., a 3 kohm resistor in one embodiment) may be connected between power terminals 172 and 173 (e.g., within the rechargeable battery pack).

Referring now to FIGS. 4-12F, tailcap assembly 130 includes various components. Where appropriate, various components of tailcap assembly 130 may be made of conductive (e.g., electrically conductive) materials (e.g., metals such as aluminum, brass, or any other metal or other conductive materials as desired) or non-conductive materials (e.g., polymer, plastic, rubber, or other non-conductive materials as desired). Also, where appropriate, various components of tailcap assembly 130 may be held together through any desired techniques (e.g., friction, soldering, or other techniques).

Figure 4:
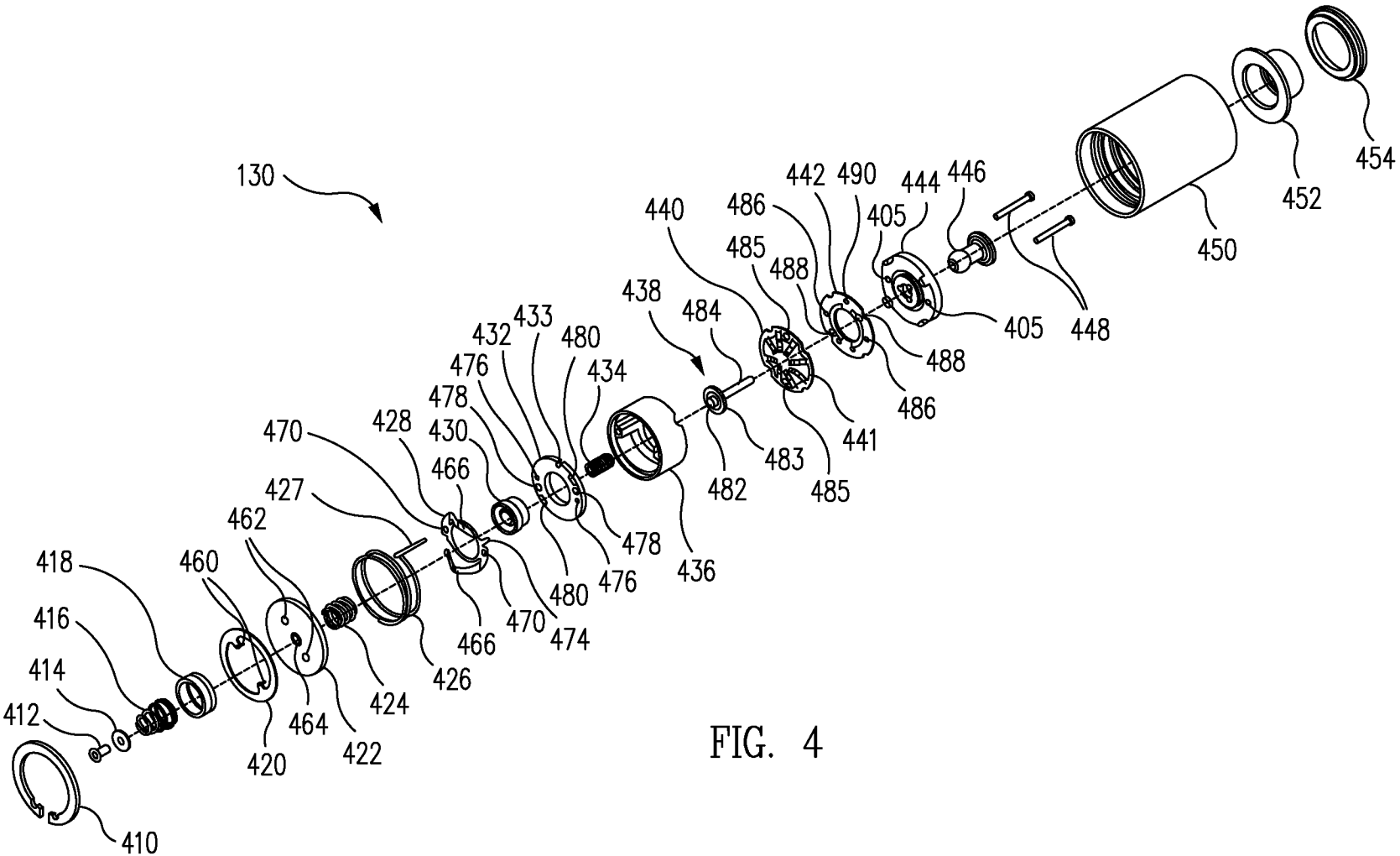
FIG. 4 is an exploded view of a tailcap assembly of the flashlight of FIG. 1 in accordance with an embodiment.

As shown in FIG. 4, tailcap assembly 130 includes a retaining ring 410, an eyelet 412, a washer 414, a spring 416, a retainer 418, a washer 420, a PCB 422, a spring 424, a spring 426, a washer 428, a bushing 430, a PCB 432, a spring 434, a housing 436, a joystick 438, a washer 440, a PCB 442, a housing 444, a joystick housing 446, posts 448, a tailcap 450, a cap 452, and a retainer 454.

Figure 12A:
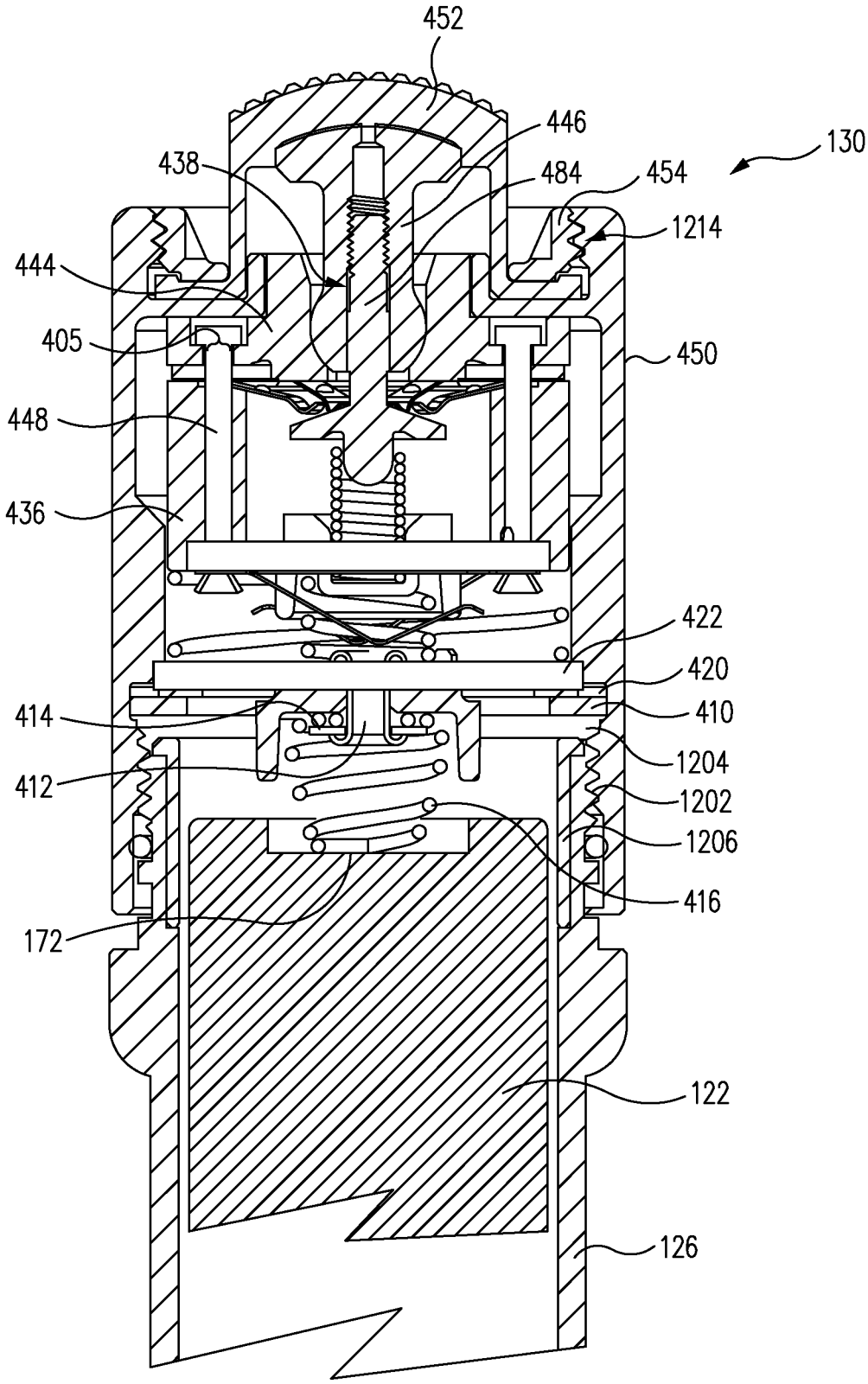
FIGS. 12A-F are sectional views of the tailcap assembly of the flashlight of FIG. 1 in various positions in accordance with several embodiments.
Figure 12B:
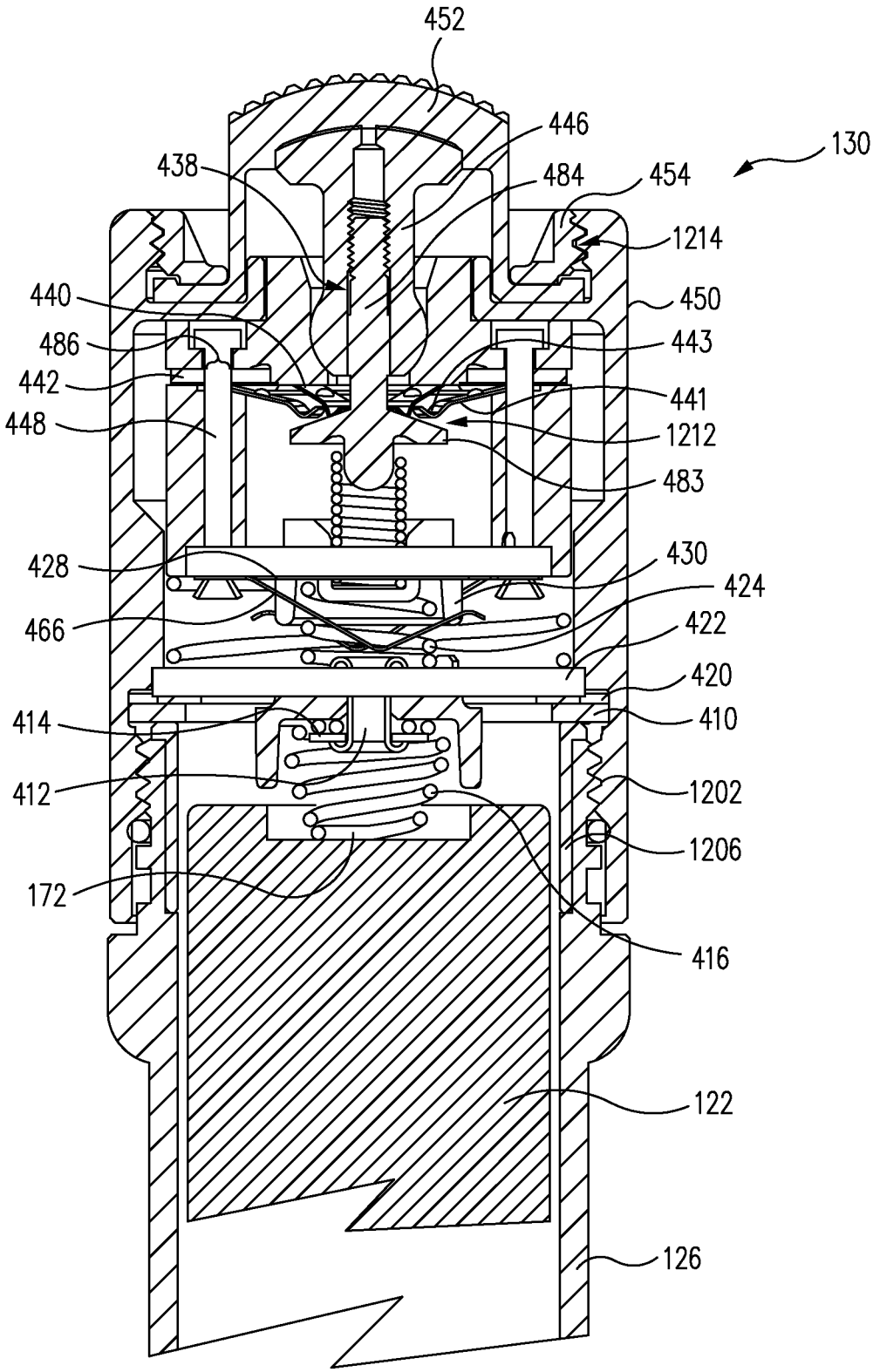

Retaining ring 410 may be conductive and may be used to electrically connect components of tailcap assembly 130 to housing 126 through a bushing 1206 (see FIG. 12B).

Eyelet 412, washer 414, and spring 416 may be conductive and may be used to electrically connect power terminal 172 to components of tailcap assembly 130 (see FIGS. 12A-F). Retainer 418 may be non-conductive in one embodiment and may be used to hold spring 416.

Washer 420 may be conductive and may be used to electrically connect retaining ring 410 to PCB 422. As shown in FIGS. 6A-C, washer 420 includes tabs 460 that may be inserted into apertures 462 of PCB 422 (see FIGS. 5A-B).

Figure 7A:
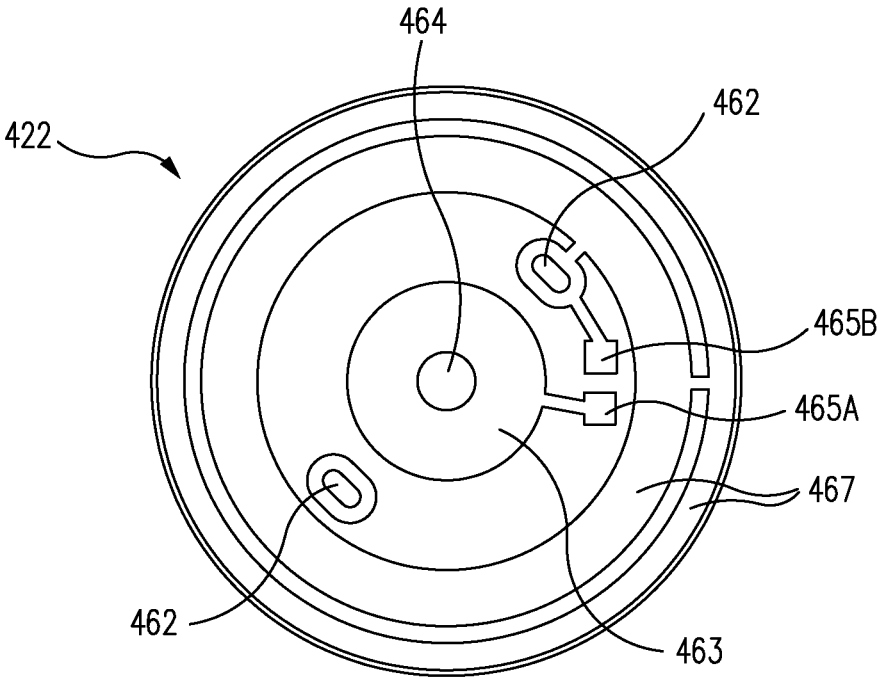
FIGS. 7A-B are various views of a printed circuit board (PCB) of the flashlight of FIG. 1 in accordance with several embodiments.
Figure 7B:
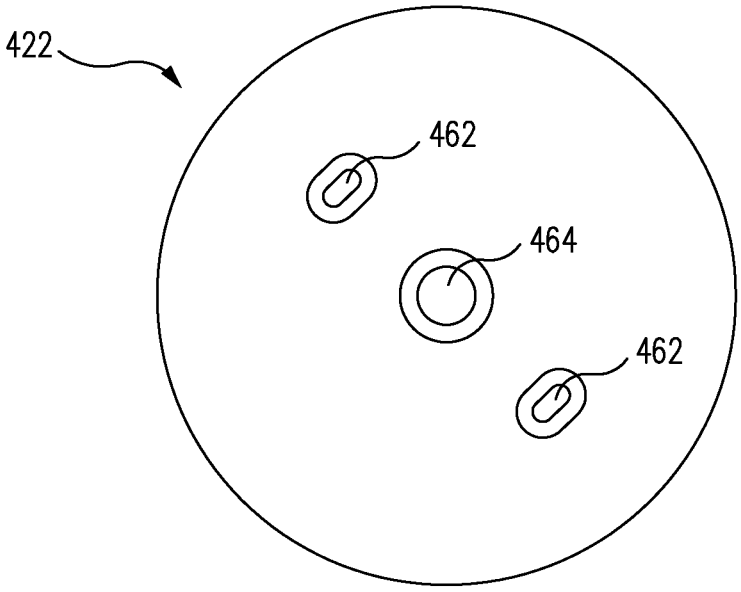

PCB 422 includes various conductive paths to support selective switching features of tailcap assembly 130. As shown in FIGS. 7A-B, PCB 422 includes apertures 462 to receive tabs 460 of washer 420 as discussed. The topmost one of apertures 462 in FIG. 7A is connected to conductive paths 467 and pad 465B. As shown in FIG. 3, pad 465B may be connected to resistor 150 that may be connected to pad 465A. Pad 465A is connected to conductive path 463 which surrounds an aperture 464. Aperture 464 may receive eyelet 412 to electrically connect conductive path 463 to power terminal 172 through various components as described herein.

Spring 424 may be conductive and may be used to electrically connect conductive path 463 of PCB 422 to bushing 430.

Spring 426 may be conductive and may be used to electrically connect conductive paths 467 of PCB 422 to PCB 442. In this regard, spring 426 includes a pigtail 427 which may extend through a recess 433 in PCB 432 and an aperture 490 of PCB 442 to connect to PCB 442 through aperture 490 (see FIGS. 5A-B).

Figure 8A:
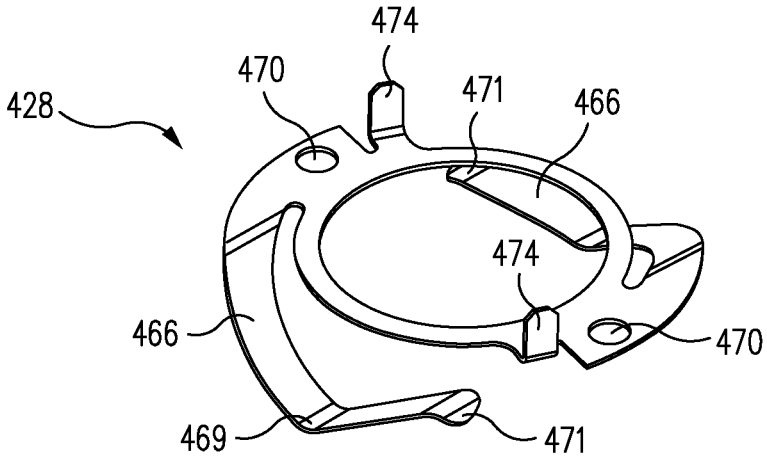
FIGS. 8A-C are various views of another washer of the flashlight of FIG. 1 in accordance with several embodiments.
Figure 8B:
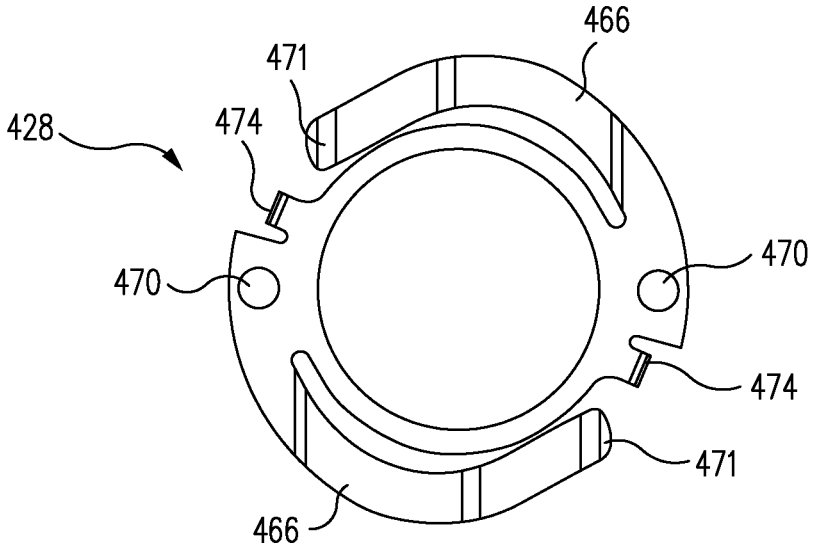
Figure 8C:
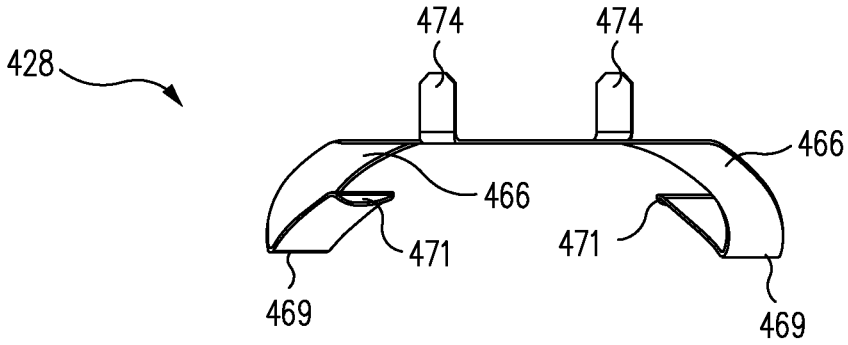

Washer 428 may be conductive and may be used to electrically connect various components of tailcap assembly 130 as described herein. As shown in FIGS. 8A-C, washer 428 includes arms 466. In various embodiments, a plurality of arms 466 may be provided to provide redundant connections (e.g., in the event that one of arms 466 fails to provide a connection as expected, one or more remaining arms 466 may provide the connection). Arms 466 include intermediate portions 469 (e.g., bent portions) which may be used to selectively contact conductive paths 467 of PCB 422 in response to downward pressure applied in the direction of an arrow 1208 (see FIG. 12C). Arms 466 also include ends 471 which may be used to selectively contact conductive paths 480 of PCB 432 in response to downward pressure applied in the direction of arrow 1208 (see FIGS. 9A-B and 12D). Washer 428 also includes tabs 474 which may be inserted into apertures 478 of PCB 432 (see FIG. 5A). Washer 428 also includes apertures 470 which may receive posts 448 (see FIGS. 12C-D).

Figure 9A:
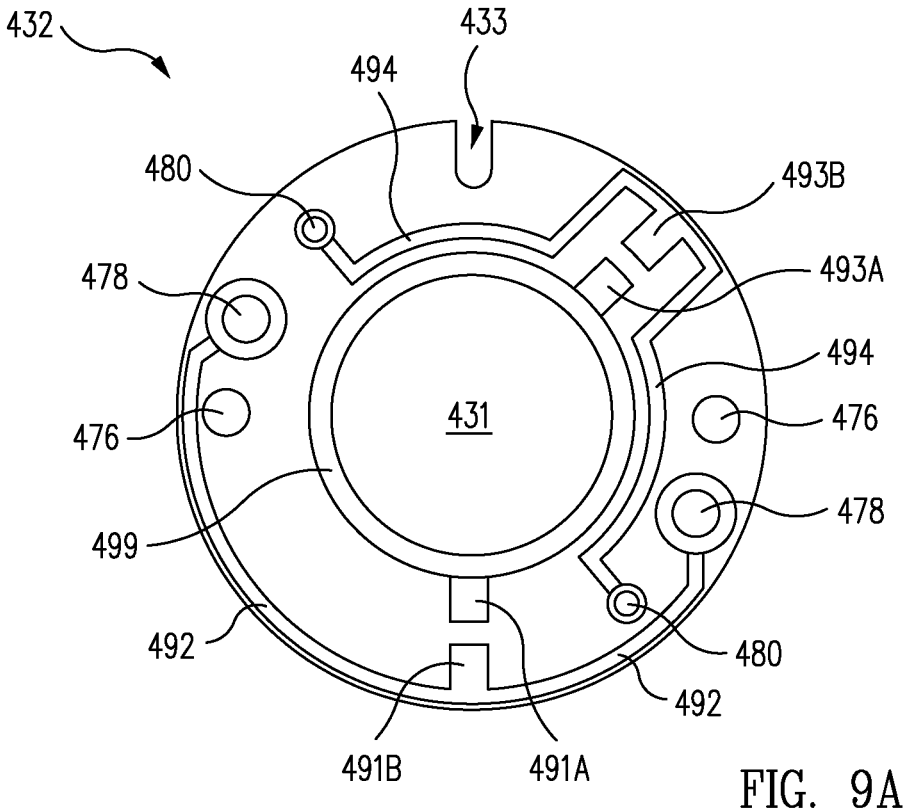
FIGS. 9A-B are various views of another PCB of the flashlight of FIG. 1 in accordance with several embodiments.
Figure 12C:
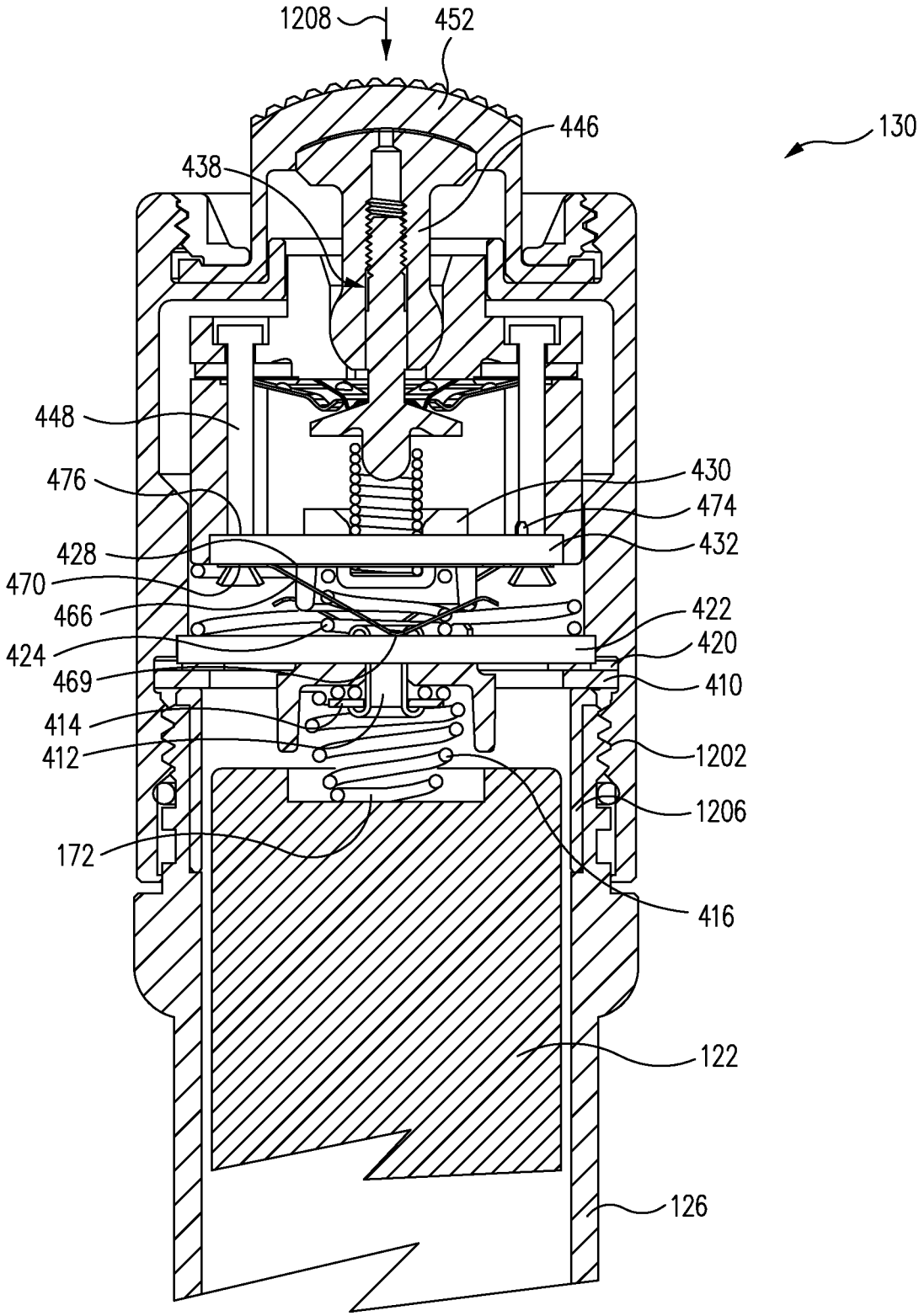
Figure 12D:
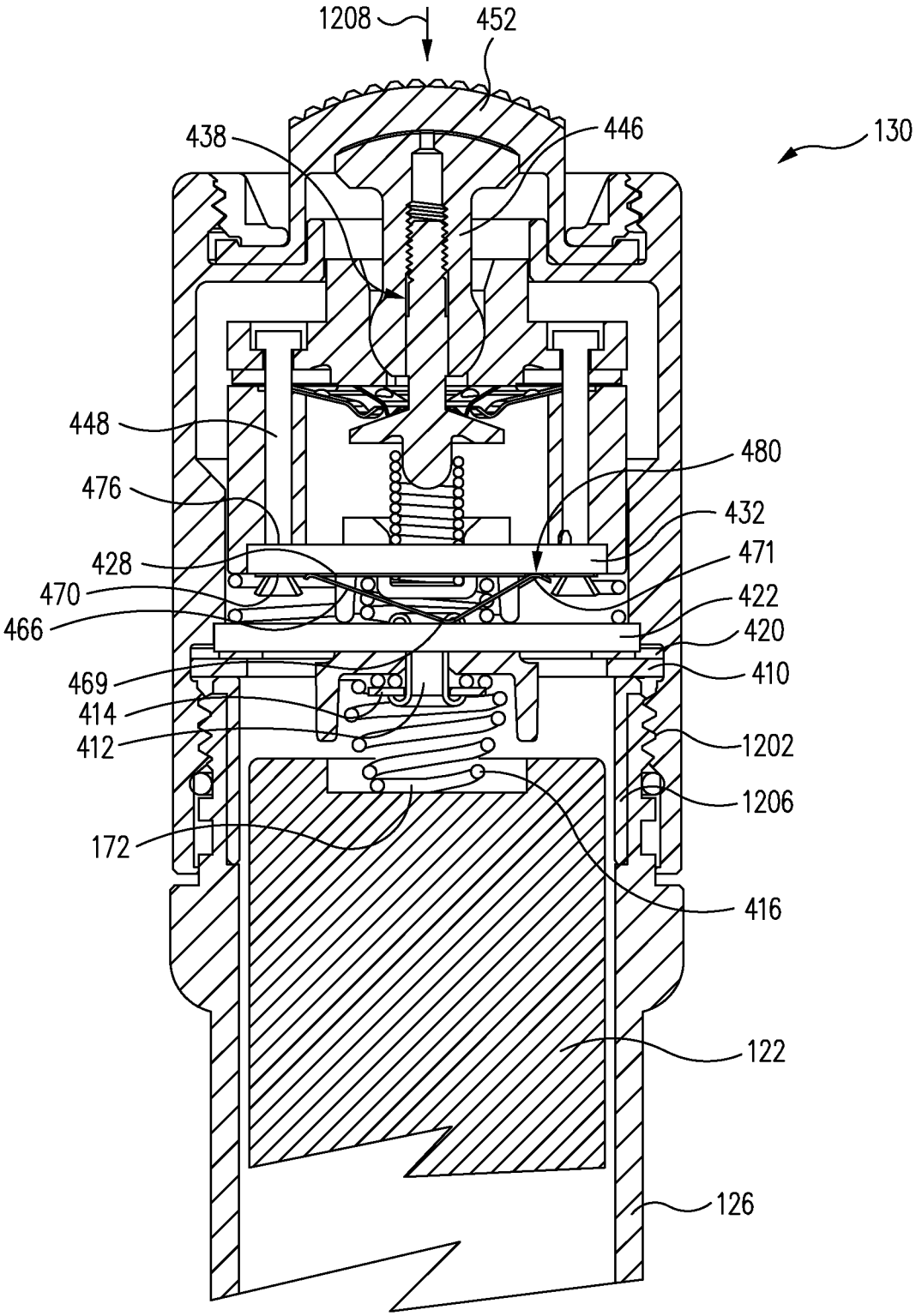
Figure 12E:
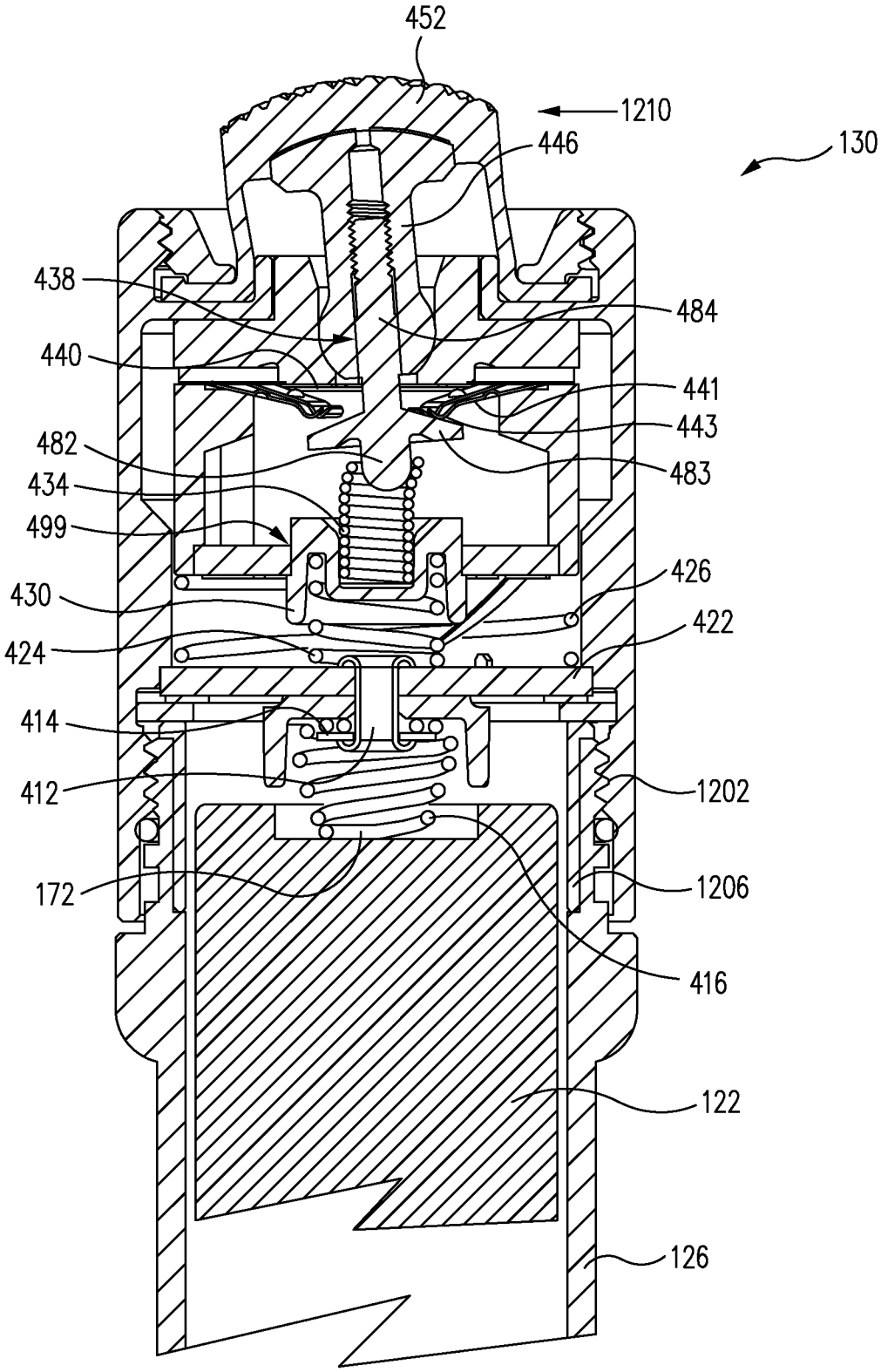
Figure 12F:
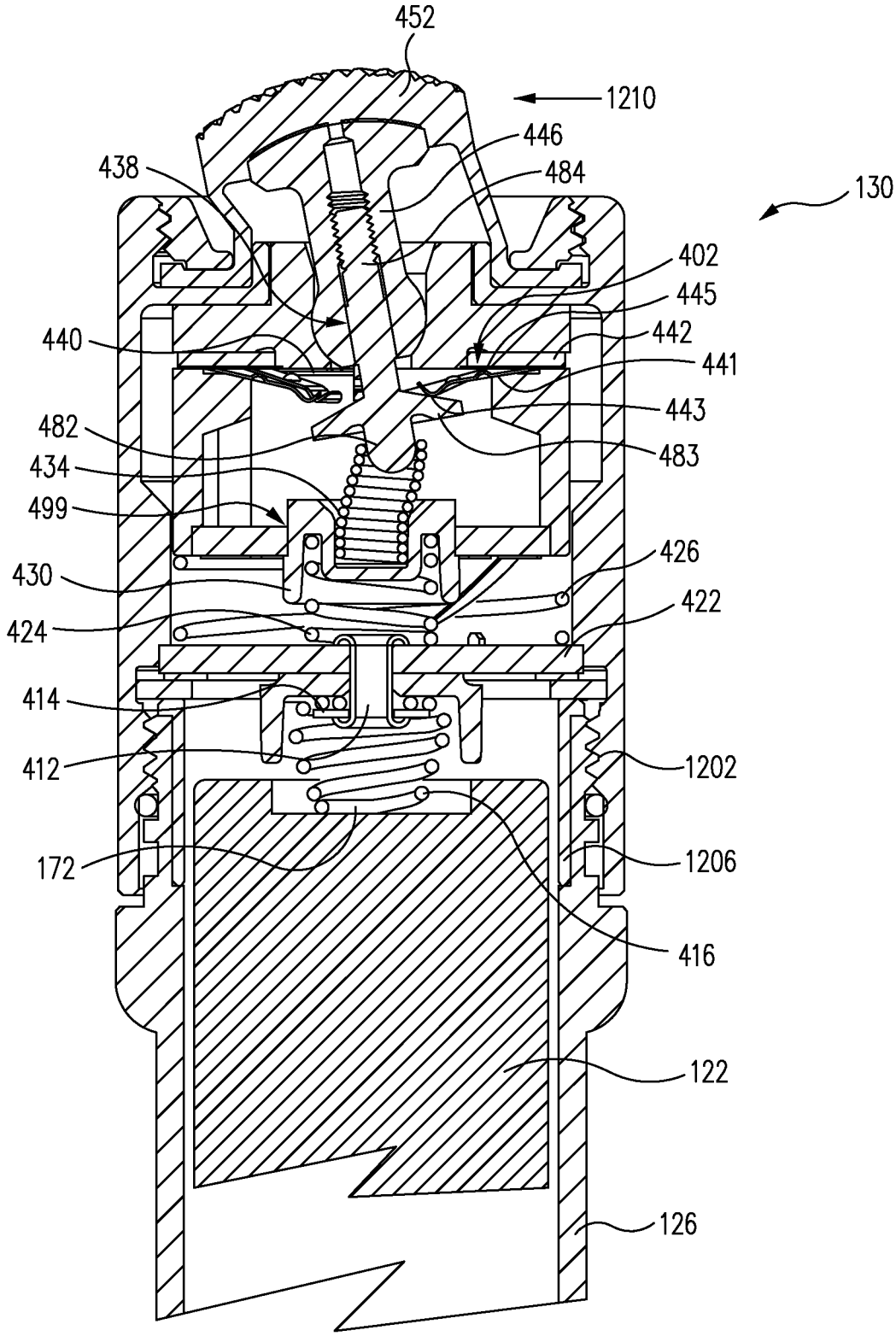

Bushing 430 may be conductive and may be used to electrically connect spring 424 to conductive path 499 of PCB 432 (see FIGS. 9A and 12E-F).

Figure 9B:
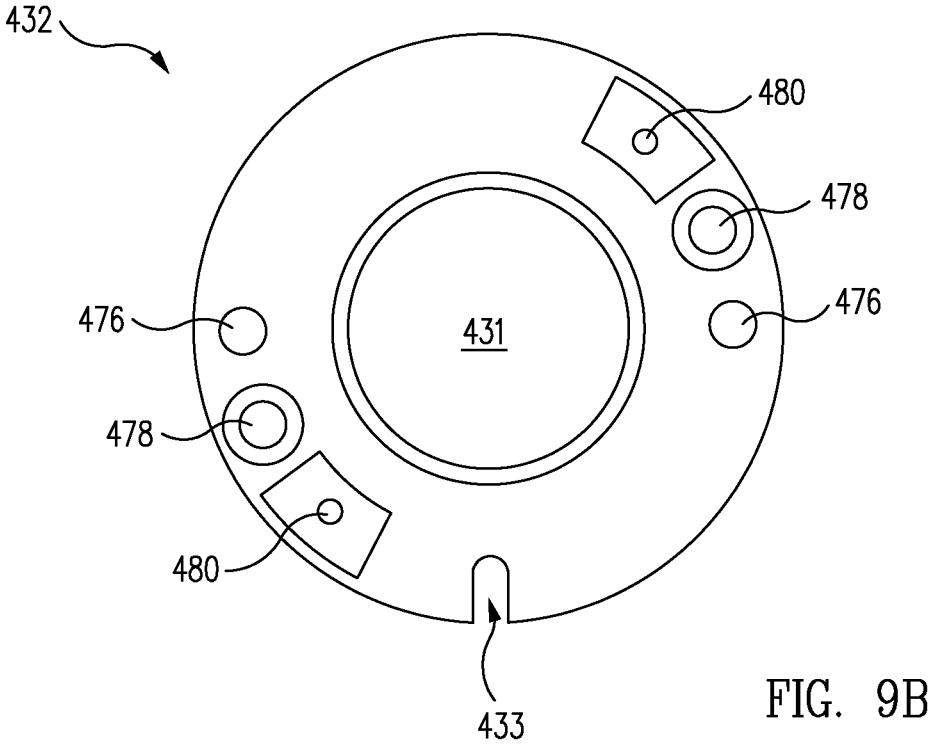
Figure 10A:
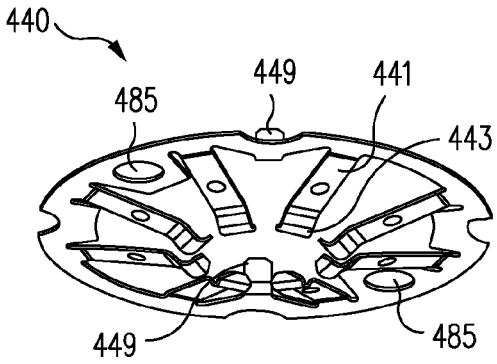
FIGS. 10A-E are various views of a further washer of the flashlight of FIG. 1 in accordance with several embodiments.
Figure 10B:
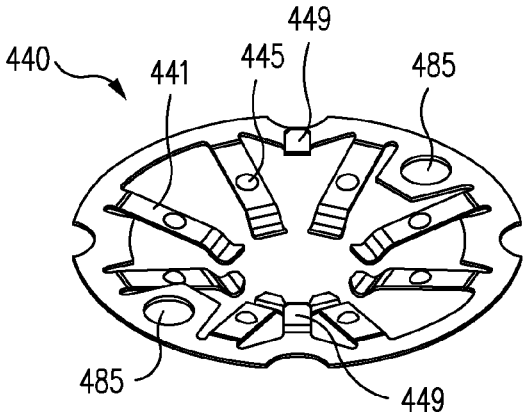
Figure 10C:
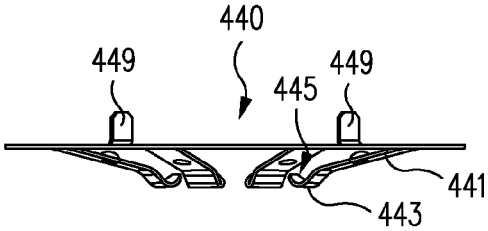
Figure 10D:
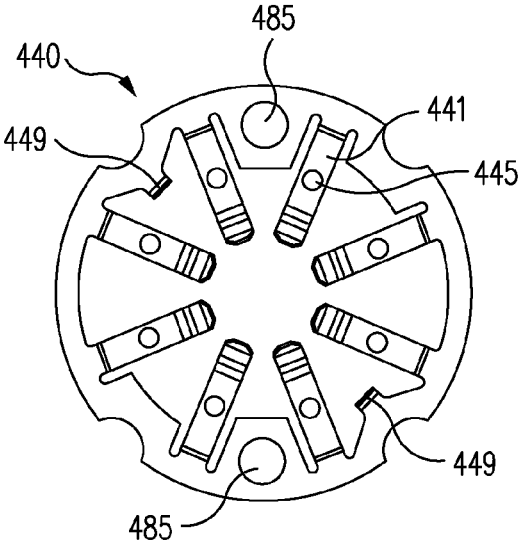
Figure 10E:
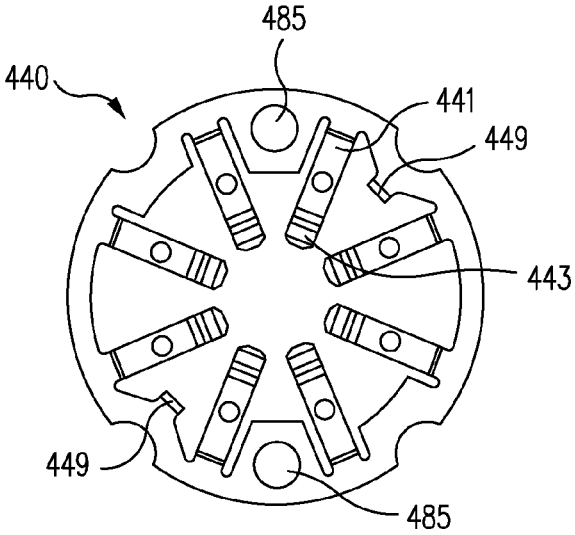

PCB 432 includes various conductive paths to support selective switching features of tailcap assembly 130. As shown in FIGS. 9A-B, PCB 432 includes apertures 478 to receive tabs 474 of washer 428 as discussed. Apertures 478 are connected to pad 491B through conductive paths 492. As shown in FIG. 3, pad 491B may be connected to resistor 152 that may be connected to pad 491A. Pad 491A is connected to conductive path 499 that surrounds an aperture 431. Conductive path 499 may be connected to spring 424 by bushing 430 as discussed.

PCB 432 also includes conductive paths 480 (e.g., which may be implemented as conductive through holes in one embodiment). As discussed, ends 471 of arms 466 of washer 428 may selectively contact conductive paths 480. Conductive paths 480 may be used to connect washer 428 to conductive paths 494. Conductive paths 494 are connected to pad 493B. As shown in FIG. 3, pad 493B may be connected to resistor 154 that may be connected to pad 493A. Pad 493A is connected to conductive path 499 which may be connected to spring 424 by bushing 430 as discussed.

PCB 432 also includes a recess 433 which may receive pigtail 427 of spring 426 as discussed. PCB 432 also includes apertures 476 which may receive posts 448 (see FIGS. 12C-D).

Spring 434 may be conductive and may be used to electrically connect bushing 430 to an end 482 of joystick 438 (see FIGS. 12E-F).

Housing 436 may be made of non-conductive material and may be used to enclose and insulate various components of tailcap assembly 130 (see FIG. 12A).

Joystick 438 may be conductive and may be used to selectively close various switches in response to vertical and/or lateral pressure applied by a user. Joystick 438 includes an end 482, a protrusion 483 (e.g., a ring in one embodiment), and a body 484. As shown in FIGS. 12E-F, end 482 may be positioned in spring 434 which may provide on-axis centering. In this regard, as lateral pressure is applied by a user, joystick 438 may pivot (see FIGS. 12E-F). However, after such lateral pressure is released, spring 434 may return joystick 438 to a centered position (e.g., substantially coaxial with tailcap assembly 130) as shown in FIG. 12B. Protrusion 483 may be used to selectively contact washer 440 as further discussed.

Washer 440 may be conductive and may be used to electrically connect various components of tailcap assembly 130 as described herein. As shown in FIGS. 10A-E, washer 440 includes arms 441. Arms 441 include ends 443 (e.g., protrusions on bottom surfaces) which may be used to selectively contact protrusion 483 of joystick 438 as joystick 438 pivots in response to lateral pressure. For example, as shown in FIG. 1213, in the absence of lateral pressure, a gap 1212 exists between protrusion 483 of joystick 438 and ends 443 of washer 440. As lateral pressure is initially applied to joystick 438 in the direction of an arrow 1210, protrusion 483 pivots with joystick 438 and contacts one or more ends 443 of washer 440 (see FIG. 12E). As a result, washer 440 will become connected to joystick 438.

Arms 441 of washer 440 also include protrusions 445 (e.g., dimples, bumps, or tabs) on top surfaces which may be used to selectively contact one or more conductive paths 402 of PCB 442 (see FIG. 11B) as joystick 438 pivots in response to further lateral pressure. For example, as shown in FIG. 12F, as further lateral pressure is applied to joystick 438 in the direction of arrow 1210, protrusions 445 pivot with joystick 438 and contact one or more conductive paths 402 of PCB 442. As a result, one or more conductive paths 402 of PCB 442 will become connected to joystick 438.

In various embodiments, a plurality of arms 441 may be provided around joystick 438 such that one or more of antis 441 may contact joystick 438 when joystick is moved in any lateral direction. Such a plurality of arms 441 may also provide redundant connections (e.g., in the event that one of arms 441 fails to provide a connection as expected, one or more remaining arms 441 may provide the connection).

Figure 5A:
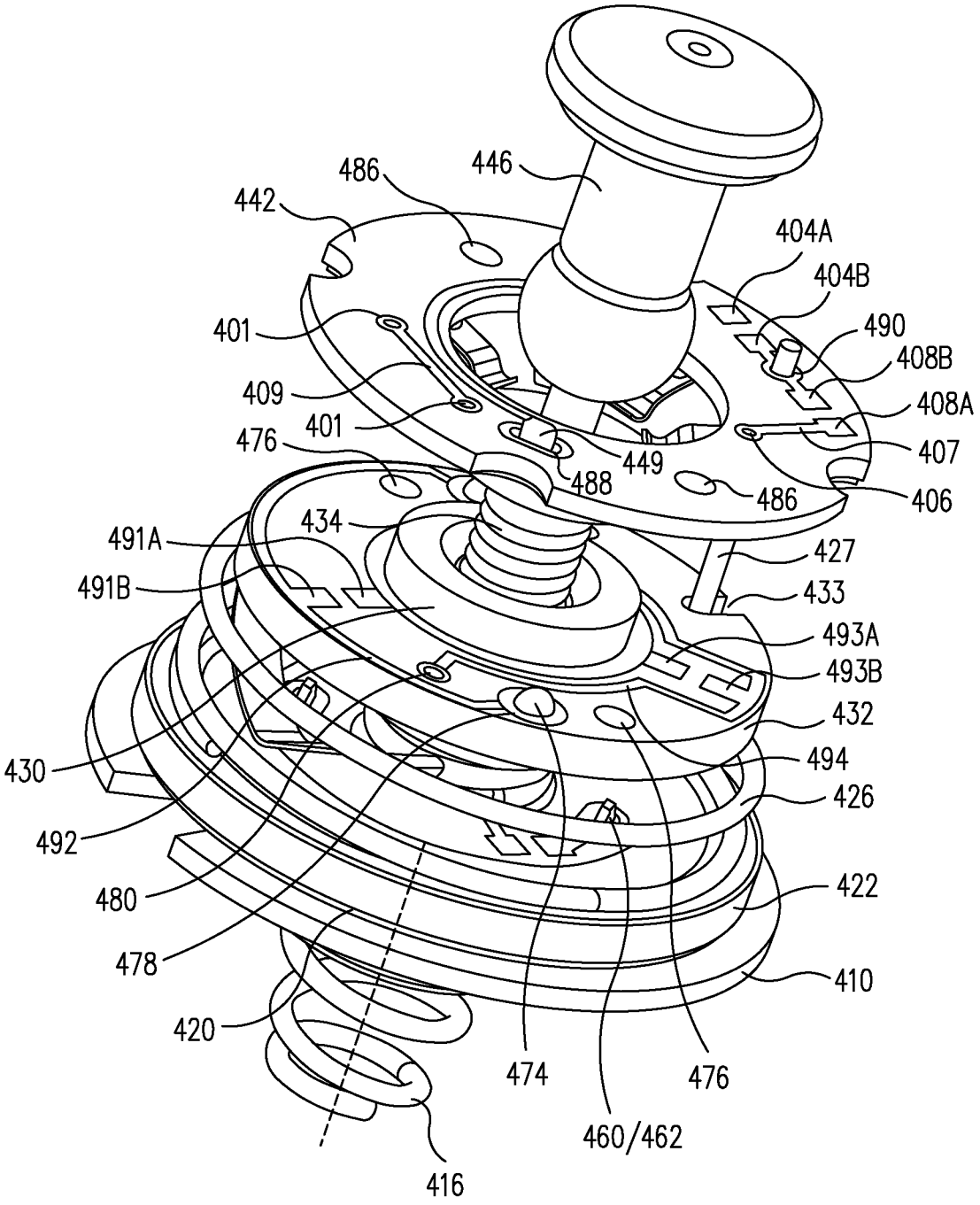
FIGS. 5A-B are various views of portions of the tailcap assembly of the flashlight of FIG. 1 in accordance with several embodiments.
Figure 5B:
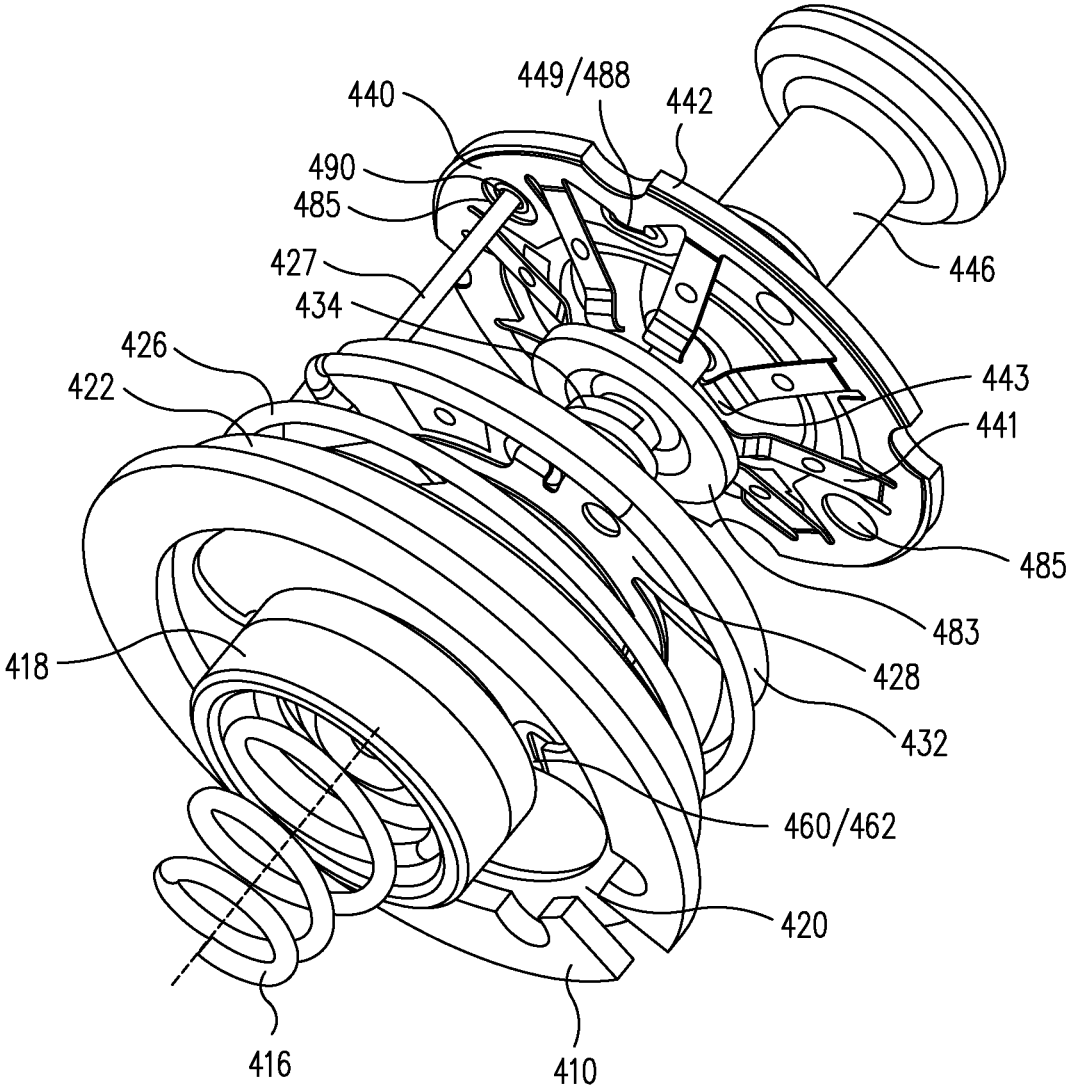
Figure 6A:
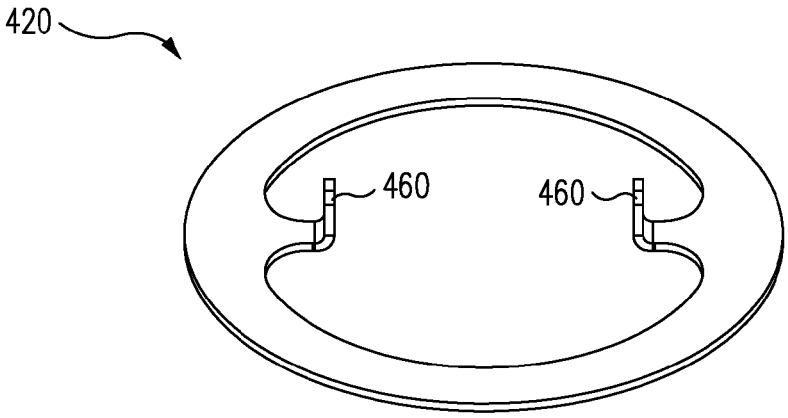
FIGS. 6A-C are various views of a washer of the flashlight of FIG. 1 in accordance with several embodiments.
Figure 6B:
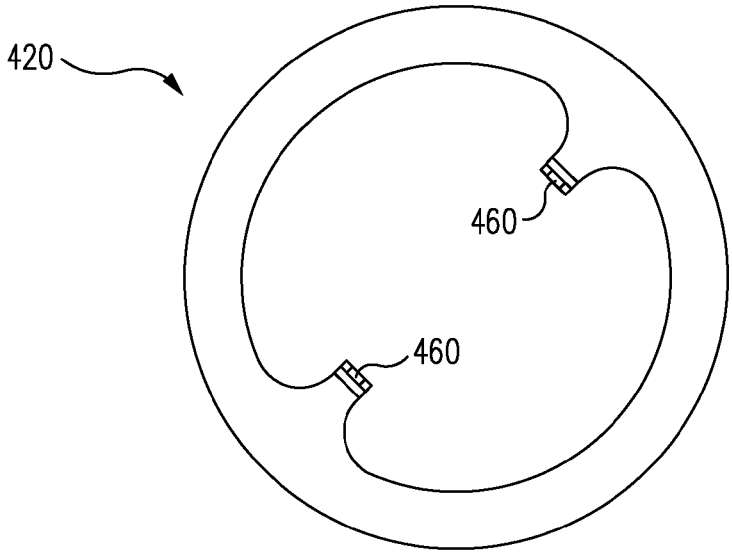
Figure 6C:
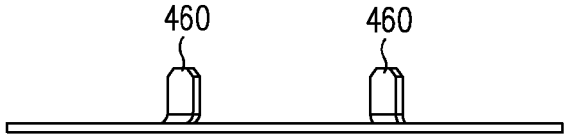

Washer 440 also includes tabs 449 which may be inserted into apertures 488 of PCB 442 (see FIG. 5A). Washer 440 also includes apertures 485 which may receive pigtail 427 of spring 426 (see FIG. 5B). Posts 448 may pass between arms 441 of washer 440.

Figure 11A:
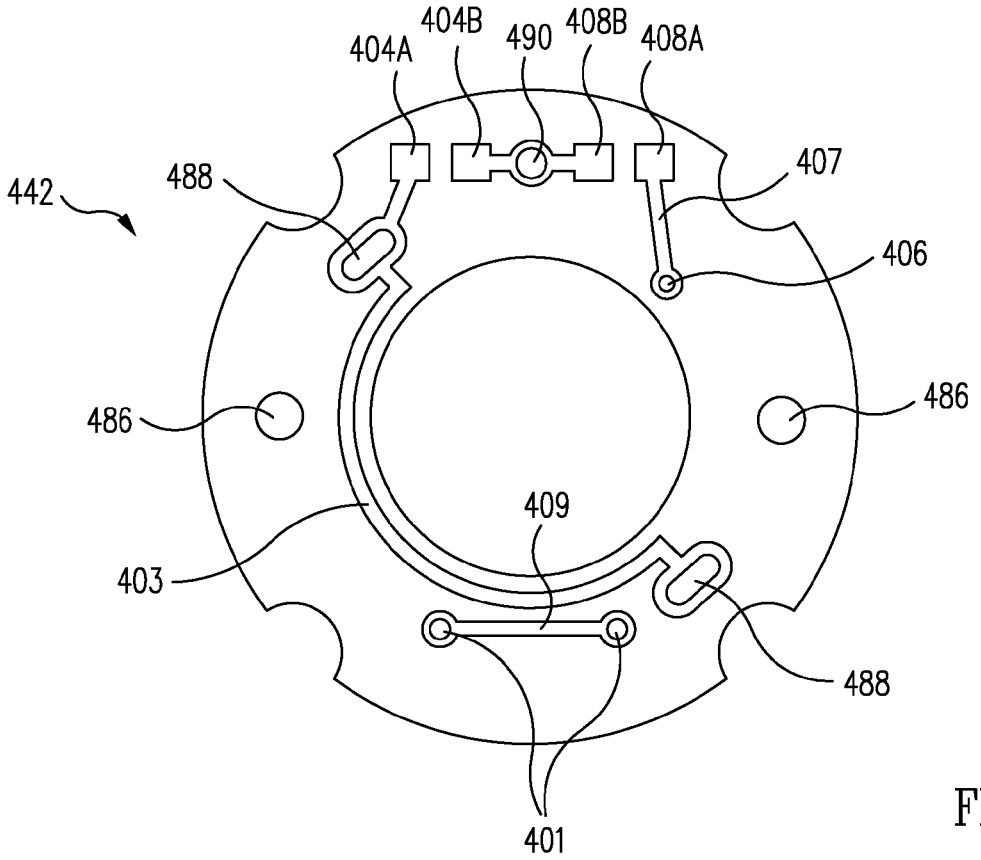
FIGS. 11A-B are various views of a further PCB of the flashlight of FIG. 1 in accordance with several embodiments.
Figure 11B:
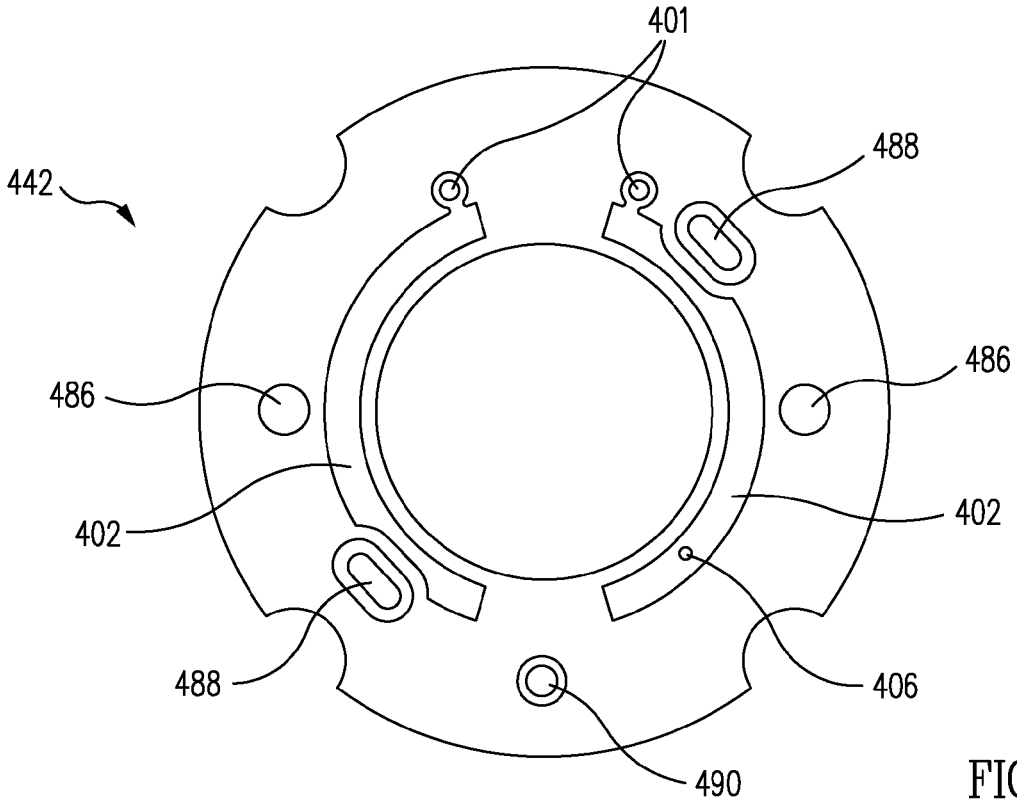

PCB 442 includes various conductive paths to support selective switching features of tailcap assembly 130. As shown in FIGS. 11A-B, PCB 442 includes apertures 488 to receive tabs 449 of washer 428 as discussed. Apertures 488 are connected to a conductive path 403 and pad 404A. As shown in FIG. 3, pad 404A may be connected to resistor 156 that may be connected to pad 404B. Pad 404B is connected to aperture 490 which is connected to spring 426 as discussed (see FIGS. 5A-B).

PCB 442 also includes conductive paths 402 which are connected together by conductive paths 401 (e.g., which may be implemented as conductive through holes in one embodiment) and conductive path 409. Conductive paths 402 are also connected to a conductive path 407 and pad 408A through a conductive path 406 (e.g., which may be implemented as a conductive through hole in one embodiment). As shown in FIG. 3, pad 408A may be connected to resistor 158 that may be connected to pad 408B. Pad 408B is connected to aperture 490 which is connected to spring 426 as discussed (see FIGS. 5A-B). PCB 442 also includes apertures 486 which may receive posts 448 (see FIG. 12B).

Housing 444 may be made of non-conductive material and may engage with housing 436 to enclose and insulate various components of tailcap assembly 130 (see FIG. 12A). Housing 444 also includes apertures 405 which may receive posts 448 (see FIG. 12A).

Joystick housing 446 engages with joystick 438 and cap 452, and may move with joystick 438 and cap 452 as vertical or lateral pressure is applied to joystick 438 (see FIGS. 12C-F).

Posts 448 may be engaged with various components of tailcap assembly 130 through apertures 405, 470, 476, and 486 as discussed (see FIGS. 12A-D).

Tailcap 450 may be engaged with housing 126 through complementary threads 1202 (see FIGS. 12A-B). In this regard, tailcap 450 may be rotated relative to housing 126 to cause various components of tailcap assembly 130 to move in relation to housing 126 (see FIGS. 12A-B).

Cap 452 may be engaged with tailcap 450 and further may be engaged with joystick housing 446 (see FIGS. 12A-B). In this regard, joystick housing 446 and joystick 438 may move in response to vertical or lateral pressure applied to cap 452 by a user.

Retainer 454 may be engaged with tailcap 450 through complementary threads 1214 (see FIGS. 12A-B).

FIGS. 12A-F are sectional views of the tailcap assembly of flashlight 100 in various positions in accordance with several embodiments. FIG. 12A is a sectional view of tailcap assembly 130 in a lockout position wherein switch 140 is open. While tailcap assembly 130 is in the lockout position, a conductive path is provided from power terminal 172 to retaining ring 410. In this regard, power terminal 172 is connected to retaining ring 410 through: spring 416, eyelet 412, washer 414, aperture 464, conductive path 463, pad 465A, resistor 150, pad 465B, at least one of apertures 462, at least one of tabs 460, and a bottom surface of washer 420 proximate retaining ring 410.

In FIG. 12A, a gap 1204 is present between retaining ring 410 and bushing 1206 which is connected to housing 126. In this regard, retaining ring 410 and bushing 1206 effectively provide contacts of switch 140. When retaining ring 410 does not contact bushing 1206 (e.g., when gap 1204 is present), then switch 140 is open. In one embodiment, when tailcap assembly 130 is in the position of FIG. 12A, flashlight 100 may be locked such that user operation of joystick 438 does not change the operation of lighting control circuitry 116 or light source 114 (e.g., the user controls are locked out).

FIG. 12B is a sectional view of tailcap assembly 130 in a standby position wherein switch 140 is closed. Tailcap 450 can be manipulated (e.g., rotated) relative to housing 126 through engagement of complementary threads 1202. After rotation, retaining ring 410 contacts bushing 1206, thus closing gap 1204. This effectively closes switch 140 which causes resistor 150 (e.g., connected to pads 465A-B of PCB 422) to be introduced between power terminal 172 and housing 126. As a result, switching signals may be provided to lighting control circuitry 116 through housing 126 by selectively opening and closing various combinations of the remaining switches 142, 144, 146, and 148 which cause various combinations of the remaining resistors 152, 154, 156, and 158 to be selectively connected between power terminal 172 and housing 126.

While tailcap assembly 130 in the position of FIG. 12B, power terminal 172 is also connected to arms 466 of washer 428. In this regard, it will be appreciated from the discussion of FIG. 12A that a conductive path is provided from power terminal 172 to conductive path 463 of PCB 422. A further conductive path is provided from conductive path 463 of PCB 422 to arms 466 of washer 428 through: spring 424, bushing 430, aperture 431, conductive path 499, pad 491A, resistor 152, pad 491B, conductive path 492, apertures 478, tabs 474, and washer 428.

From the standby position of FIG. 12B, a user may manipulate (e.g., apply pressure against) joystick 438 by pushing on cap 452 in the direction of arrow 1208. This causes various components of tailcap assembly 130 to move in the direction of arrow 1208 to the position of FIG. 12C. In particular, arms 466 of washer 428 are pushed down toward PCB 422 until intermediate portions 469 of washer 428 contact conductive paths 467 of PCB 422.

As shown in FIG. 7A, conductive paths 467 of PCB 422 are connected to at least one of apertures 462. As discussed, a conductive path is provided from apertures 462 to housing 126 as a result of the previous rotation of tailcap 450 toward housing 126. Accordingly, when the various components of tailcap assembly 130 are moved to the position shown in FIG. 12C, switch 142 is effectively closed which causes resistor 152 to be introduced between power terminal 172 and housing 126 (e.g., in parallel with resistor 150).

While tailcap assembly 130 in the position of FIG. 12C, a user may further manipulate (e.g., apply further pressure against) joystick 438 by further pushing on cap 452 in the direction of arrow 1208. This causes various components of tailcap assembly 130 to further move in the direction of arrow 1208 to the position of FIG. 12D.

In particular, while tailcap assembly 130 is in the position of FIG. 12D, the ends 471 of arms 466 are pushed up toward PCB 432 such that the ends 471 contact conductive paths 480. As shown in FIG. 9A, conductive paths 480 connect to pad 493B through conductive paths 494. As also shown in FIG. 9A, pad 493A is connected to conductive path 499. From the discussion of FIG. 12C, it will be appreciated that a conductive path is provided from conductive path 499 to power terminal 172. Accordingly, when the various components of tailcap assembly 130 are moved in the manner shown in FIG. 12D, switch 144 is effectively closed which causes resistor 154 to be introduced between power terminal 172 and housing 126 (e.g., in parallel with resistors 150 and 152 while switches 140 and 142 are closed in one embodiment).

FIG. 12E is a sectional view of tailcap assembly 130 after a further manipulation (e.g., an initial lateral pressure) has been applied to joystick 438. In this regard, lateral (e.g., horizontal) pressure may be applied to joystick 438 by pushing cap 452 in the direction of arrow 1210.

When no lateral pressure is applied, a gap 1212 exists between protrusion 483 of joystick 438 and ends 443 of arms 441 of washer 440 (see FIG. 12B). As shown in FIG. 12E, after an initial lateral pressure is applied, joystick 438 pivots (e.g., to a position approximately 7 degrees from coaxial alignment with flashlight 100 in one embodiment), gap 1212 is closed, and protrusion 483 of joystick 438 contacts one or more ends 443 of one or more arms 441 of washer 440 (see FIG. 12E).

As discussed herein, a conductive path is provided from power terminal 172 to bushing 430. Spring 434 provides a farther conductive path from bushing 430 to end 482 of joystick 438. Thus, while joystick 438 contacts washer 440, power terminal 172 is electrically connected to washer 440.

Washer 440 is electrically connected to housing 126 through: tabs 449, apertures 488, conductive path 403, pad 404A, resistor 156, pad 404B, aperture 490, spring 426, conductive paths 467, at least one of apertures 462, at least one of tabs 460, washer 420, retaining ring 410, and bushing 1206. Accordingly, when the various components of tailcap assembly 130 are moved in the manner shown in FIG. 12E, switch 146 is effectively closed which causes resistor 156 to be introduced between power terminal 172 and housing 126 (e.g., in parallel with resistor 150 while switch 140 is closed in one embodiment).

FIG. 12F is a sectional view of tailcap assembly 130 after a further manipulation (e.g., further lateral pressure) has been applied to joystick 438. In this regard, further lateral pressure may be applied to joystick 438 by pushing cap 452 in the direction of arrow 1210.

As shown in FIG. 12F, after a further lateral pressure is applied, joystick 438 pivots (e.g., to a position approximately 15 degrees from coaxial alignment with flashlight 100 in one embodiment) and one or more arms 441 of washer 440 are pushed toward PCB 442 such that one or more protrusions 445 of arms 441 are caused to contact one or more of conductive paths 402 of PCB 442.

Conductive paths 402 care connected to housing 126 through: conductive paths 401, conductive path 409, conductive path 406, conductive path 407, pad 408A, resistor 158, pad 408B, aperture 490, spring 426, conductive paths 467, at least one of apertures 462, at least one of tabs 460, washer 420, retaining ring 410, and bushing 1206. Accordingly, when the various components of tailcap assembly 130 are moved in the manner shown in FIG. 12F, switch 148 is effectively closed which causes resistor 158 to be introduced between power terminal 172 and housing 126 (e.g., in parallel with resistors 150 and 156 while switches 140 and 149 are closed in one embodiment).

It will be appreciated that tailcap assembly 130 may be selectively moved between any of the positions of FIGS. 12B-F by repeatedly applying and releasing vertical and/or lateral pressure in relation to cap 452 (e.g., which causes joystick 438 to move accordingly). Lighting control circuitry 116 may detect the selective connection and disconnection of the various switches and resistors as signals provided through housing 126. Lighting control circuitry 116 may operate light source 114 in any desired manner in response to such signals.

Although certain combinations of switches 140, 142, 144, 146, and 148 have been described with regard to tailcap assembly 130, it will be appreciated that any desired combinations may be used. For example, in certain embodiments, downward and lateral pressure may be simultaneously applied to joystick 438 as desired to simultaneously close one or more of switches 142 and 144 while one or more of switches 146 and 148 are also closed.

In one embodiment, 16 different switched modes may be supported. For example, lighting control circuitry 116 may be configured such that if tailcap assembly 130 is adjusted to the position of FIG. 12C (e.g., through application of an initial vertical pressure), switches adjusted by simultaneous lateral pressure may or may not change the operation of light source 114 (e.g., signals provided by particular switches may be selectively recognized or ignored by lighting control circuitry 116).

Figure 13:
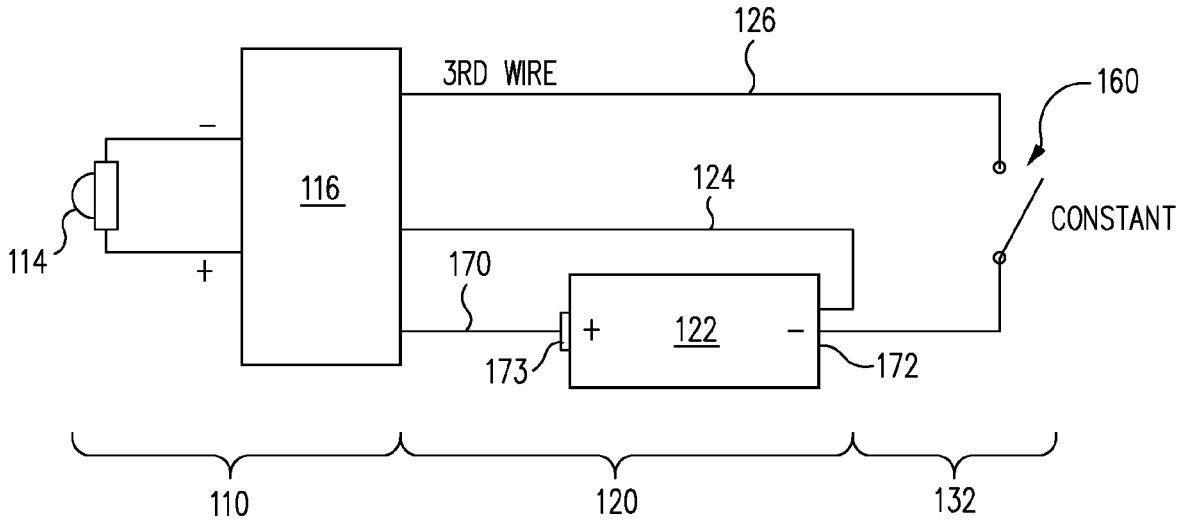
FIG. 13 is a circuit diagram which may be used to implement the flashlight of FIG. 1 with another tailcap assembly in accordance with an embodiment.

Other switch configurations are also contemplated. For example, FIG. 13 is a circuit diagram which may be used to implement flashlight 100 with another tailcap assembly 132 in accordance with an embodiment. As shown, the circuit of FIG. 13 includes various components previously discussed with regard to the circuit of FIG. 1. However, tailcap assembly 132 includes only a single switch 160 which may be used to selectively connect power terminal 172 to housing 126. For example, in one embodiment, tailcap assembly 132 may be implemented in accordance with any of the implementations identified in U.S. Pat. No. RE40,125 issued Mar. 4, 2008 which is incorporated herein by reference in its entirety.

Where applicable, the various components set forth herein can be combined into composite components and/or separated into sub-components. Where applicable, the ordering of various steps described herein can be changed, combined into composite steps, and/or separated into sub-steps to provide features described herein.

Embodiments described herein illustrate but do not limit the disclosure. It should also be understood that numerous modifications and variations are possible in accordance with the principles of the disclosure.

What is claimed is:

1. A portable lighting device comprising:
a light source;
lighting control circuitry;
a body; and
a tailcap assembly attached to an end of the body, the tailcap assembly comprising:
a multi-position joystick adapted to pivot relative to the body in response to lateral pressure and move vertically relative to the body in response to vertical pressure, and
switches adapted to provide signals to the lighting control circuitry in response to pivot movement and vertical movement of the joystick, wherein the lighting control circuitry is adapted to operate the light source in response to the signals.

2. The portable lighting device of claim 1, wherein the signals are changes in voltage, changes in current, or changes in resistance.

3. The portable lighting device of claim 1, wherein the joystick is adapted to move to a first vertical position in response to an initial application of the vertical pressure, and move from the first vertical position to a second vertical position in response to a further application of the vertical pressure.

4. The portable lighting device of claim 3, wherein the switches comprise a washer adapted to electrically connect with a first conductive path of a first printed circuit board (PCB) when the joystick is moved to the first vertical position, and electrically connect with a second conductive path of a second PCB when the joystick is moved to the second vertical position.

5. The portable lighting device of claim 4, wherein the washer comprises an arm comprising an intermediate portion adapted to electrically connect with the first conductive path, and an end portion adapted to electrically connect with the second conductive path.

6. The portable lighting device of claim 4, wherein the lighting device further comprises a power terminal, wherein the tailcap assembly further comprises first and second resistors, wherein the washer is adapted to electrically connect the first resistor between the power terminal and the lighting control circuitry and electrically connect the second resistor between the power terminal and the lighting control circuitry.

7. The portable lighting device of claim 1, wherein the joystick is adapted to pivot to a first lateral position in response to an initial application of the lateral pressure, and pivot from the first lateral position to a second lateral position in response to a further application of the lateral pressure.

8. The portable lighting device of claim 1, wherein the lighting device further comprises a power terminal, wherein the tailcap assembly further comprises a resistor, wherein the switches comprise a washer adapted to physically contact the joystick when the joystick is pivoted to a lateral position in response to the lateral pressure to electrically connect the resistor between the power terminal and the lighting control circuitry.

9. The portable lighting device of claim 8, wherein the washer comprises an arm comprising an end portion adapted to physically contact the joystick.

10. The portable lighting device of claim 1, wherein the lighting device further comprises a power terminal, wherein the tailcap assembly further comprises a resistor, wherein the switches comprise a washer adapted to electrically connect with a conductive path of a printed circuit board (PCB) when the joystick is pivoted to a lateral position in response to the lateral pressure to electrically connect the resistor between the power terminal and the lighting control circuitry.

11. The portable lighting device of claim 10, wherein the washer comprises an arm comprising a dimple adapted to electrically connect with the conductive path of the PCB.

12. The portable lighting device of claim 1, wherein the tailcap assembly further comprises a spring adapted to reposition the joystick after the lateral pressure is released.

13. A method of operating a portable lighting device comprising a light source, lighting control circuitry, a body, and a tailcap assembly comprising a multi-position joystick and a plurality of switches, the method comprising:

receiving lateral pressure at the joystick;

permitting the joystick to pivot relative to the body in response to the lateral pressure;

receiving vertical pressure at the joystick;

permitting vertical movement of the joystick relative to the body in response to the vertical pressure;

operating switches in response to pivot movement or vertical movement of the joystick;

receiving signals at the lighting control circuitry in response to the switches; and operating the light source by the lighting control circuitry in response to the signals.

14. The method of claim 13, wherein the signals are changes in voltage, changes in current, or changes in resistance.

15. The method of claim 13, wherein the joystick is adapted to move to a first vertical position in response to an initial application of the vertical pressure, and move from the first vertical position to a second vertical position in response to a further application of the vertical pressure.

16. The method of claim 15, wherein the operating the switches comprises electrically connecting a washer with a first conductive path of a first printed circuit board (PCB) when the joystick is moved to the first vertical position, and electrically connecting the washer with a second conductive path of a second PCB when the joystick is moved to the second vertical position.

17. The method of claim 16, wherein the electrically connecting the washer with the first conductive path comprises electrically connecting an intermediate portion of an arm of the washer with the first conductive path, wherein the electrically connecting the washer with the second conductive path comprises electrically connecting an end portion of the arm of the washer with the second conductive path.

18. The method of claim 16, wherein the electrically connecting the washer with the first conductive path electrically connects a first resistor between a power terminal of the lighting device and the lighting control circuitry, wherein the electrically connecting the washer with the second conductive path electrically connects a second resistor between the power terminal and the lighting control circuitry.

19. The method of claim 13, wherein the joystick is adapted to pivot to a first lateral position in response to an initial application of the lateral pressure, and pivot from the first lateral position to a second lateral position in response to a further application of the lateral pressure.

20. The method of claim 13, wherein the operating the switches comprises physically contacting a washer to the joystick when the joystick is pivoted to a lateral position in response to the lateral pressure to electrically connect a resistor between a power terminal of the lighting device and the lighting control circuitry.

21. The method of claim 20, wherein the washer comprises an arm comprising an end portion adapted to physically contact the joystick.

22. The method of claim 13, wherein the operating the switch comprises electrically connecting a washer with a conductive path of a printed circuit board (PCB) when the joystick is pivoted to a lateral position in response to the lateral pressure to electrically connect a resistor between a power terminal of the lighting device and the lighting control circuitry.

23. The method of claim 22, wherein the washer comprises an arm comprising a dimple adapted to electrically connect with the conductive path of the PCB.

24. The method of claim 13, further comprising repositioning the joystick using a spring of the tailcap assembly after the lateral pressure is released.

25. A portable lighting device comprising:

a body; and a tailcap assembly attached to an end of the body, the tailcap assembly comprising a multi-position joystick adapted to pivot relative to the body in response to lateral pressure and move vertically relative to the body in response to vertical pressure.

* * * * *